US006116322A

United States Patent [19]

Anderson et al.

[11] Patent Number: 6,116,322

[45] Date of Patent: Sep. 12, 2000

[54] CONTROL SYSTEM FOR A VERTICAL VANE COVERING FOR ARCHITECTURAL OPENINGS

[75] Inventors: Richard N. Anderson, Whitesville; Eugene W. Thompson, Maceo, both of Ky.

[73] Assignee: Hunter Douglas Inc., Upper Saddle River, N.J.

[21] Appl. No.: 08/915,793

[22] Filed: Aug. 21, 1997

Related U.S. Application Data

[63] Continuation-in-part of application No. 08/724,576, Sep. 30, 1996.

[60] Provisional application No. 60/047,075, May 19, 1997.

[51] Int. Cl.[7] ..... E06B 9/36

[52] U.S. Cl. ..... 160/168.1 V; 160/173 V; 160/178.1 V; 160/176.1 V

[58] Field of Search ..... 160/168.1 V, 173 V, 160/176.1 V, 177 V, 178.1 V, 900; 403/355, 356, 358

[56] References Cited

U.S. PATENT DOCUMENTS

| | | | |
|---|---|---|---|
| D. 231,326 | 4/1974 | Miki . | |
| D. 325,681 | 4/1992 | Gartenmaier . | |
| 2,621,723 | 12/1952 | Etten . | |
| 2,759,534 | 8/1956 | Harju . | |
| 2,854,071 | 9/1958 | Toti . | |
| 2,876,834 | 3/1959 | Walker . | |
| 3,334,682 | 8/1967 | Eldredge, Jr. . | |
| 3,486,549 | 12/1969 | Rosenquist . | |
| 3,996,988 | 12/1976 | de Wit . | |
| 4,214,622 | 7/1980 | Debs . | |
| 4,267,875 | 5/1981 | Koks . | |
| 4,293,021 | 10/1981 | Arena . | |
| 4,316,493 | 2/1982 | Arena . | |
| 4,361,179 | 11/1982 | Benthin . | |
| 4,381,029 | 4/1983 | Ford et al. . | |
| 4,386,644 | 6/1983 | Debs . | |
| 4,425,955 | 1/1984 | Kaucic . | |
| 4,628,981 | 12/1986 | Ciriaci et al. . | |
| 4,648,436 | 3/1987 | Oskam . | |
| 4,657,060 | 4/1987 | Kaucic | 160/176.1 V |
| 4,662,422 | 5/1987 | Anderson . | |
| 4,724,883 | 2/1988 | Liebowitz . | |
| 4,732,202 | 3/1988 | Anderson . | |
| 4,773,464 | 9/1988 | Kobayashi . | |

(List continued on next page.)

FOREIGN PATENT DOCUMENTS

| | | |
|---|---|---|
| 120425 | 10/1984 | European Pat. Off. . |
| 159812 | 10/1985 | European Pat. Off. . |
| 0446587 | 9/1991 | European Pat. Off. . |
| 2308280 | 11/1976 | France . |
| 9105869 | 8/1991 | Germany . |
| 868961 | 5/1961 | United Kingdom . |
| 1159635 | 7/1969 | United Kingdom . |
| 1470533 | 4/1977 | United Kingdom . |
| 2171441 | 8/1986 | United Kingdom . |
| 2247488 | 3/1992 | United Kingdom . |

*Primary Examiner*—Blair M. Johnson
*Attorney, Agent, or Firm*—Dorsey &Whitney LLP

[57] ABSTRACT

A control system for a vertical vane covering for an architectural opening includes a new and improved symmetric headrail having uniquely designed carriers for suspending individual vanes wherein the carriers are designed to minimize skewing relative to a tilt rod as they are moved along the headrail. A pantograph system is utilized to interconnect the carriers, and is connected to the carriers in alignment with the tilt rod so as to minimize skewing. The carriers have pockets formed therein through which the traverse cord extends so that the traverse cord, which moves the carriers along the tilt rod, is secured to a lead carrier closely adjacent to the tilt rod to, again, minimize skewing. Light blocking rails are also attachable to the headrail to substantially bridge the gap between the headrail and the top of the suspended vanes to prevent light from passing therebetween. The tilt rod is keyed to gears in the carriers to facilitate assembly of the control system with all vanes properly aligned.

5 Claims, 23 Drawing Sheets

U.S. PATENT DOCUMENTS 4,799,527 1/1989 Villoch et al. .
4,802,522 2/1989 Anderson .
4,834,163 5/1989 Dickstein .
4,869,309 9/1989 Evans .
4,872,499 10/1989 Anderson .
5,012,850 5/1991 Schrader .
5,088,542 2/1992 Biba et al. .
5,249,617 10/1993 Durig .
5,289,863 3/1994 Schon .
5,351,741 10/1994 Swopes .
5,400,885 3/1995 Phillips ..... 403/356

204
34
28
68
80
20
36
38
30
194
22
24
192

36
38
32
9
8

9
40
28
148
8
40
10
30
22
26
10
26
24

Fig. 4
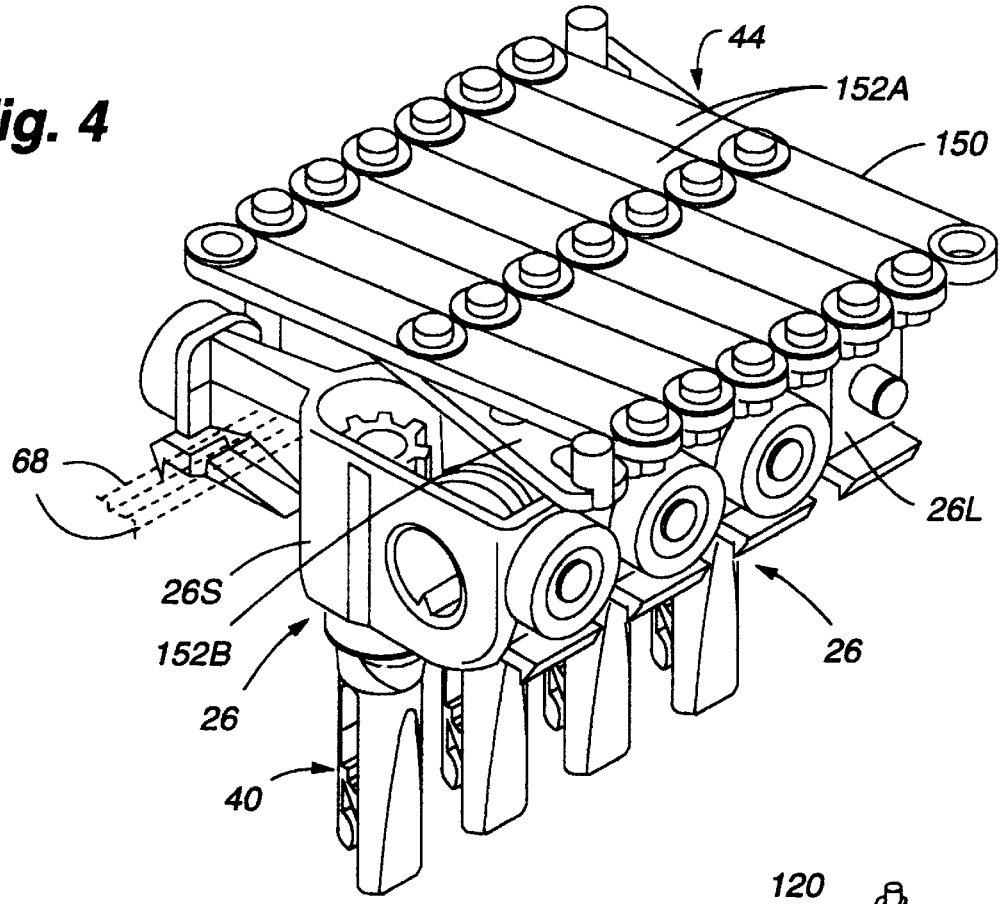
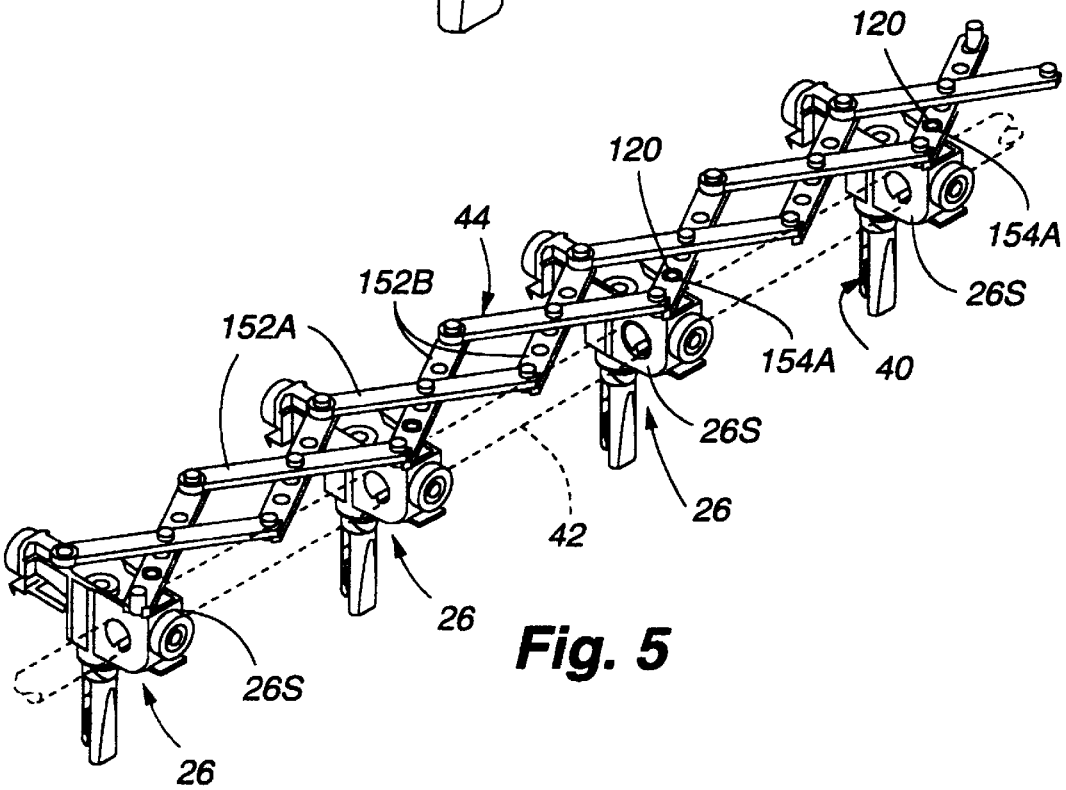
Fig. 5

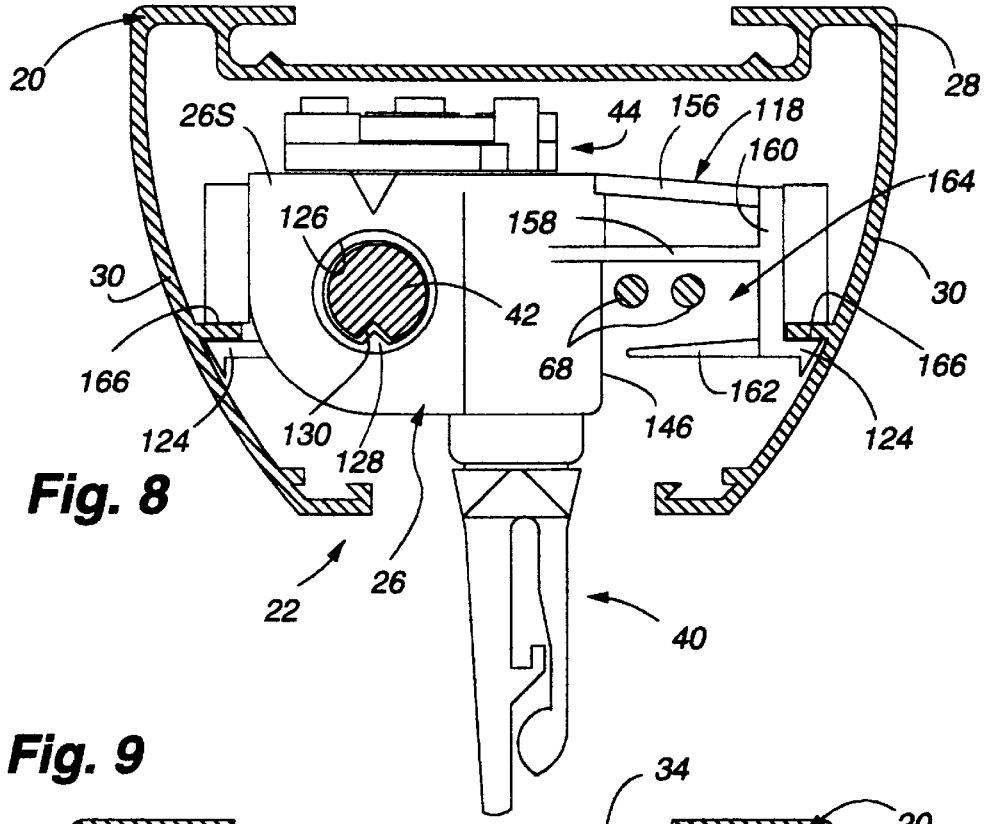
Fig. 8
Fig. 9
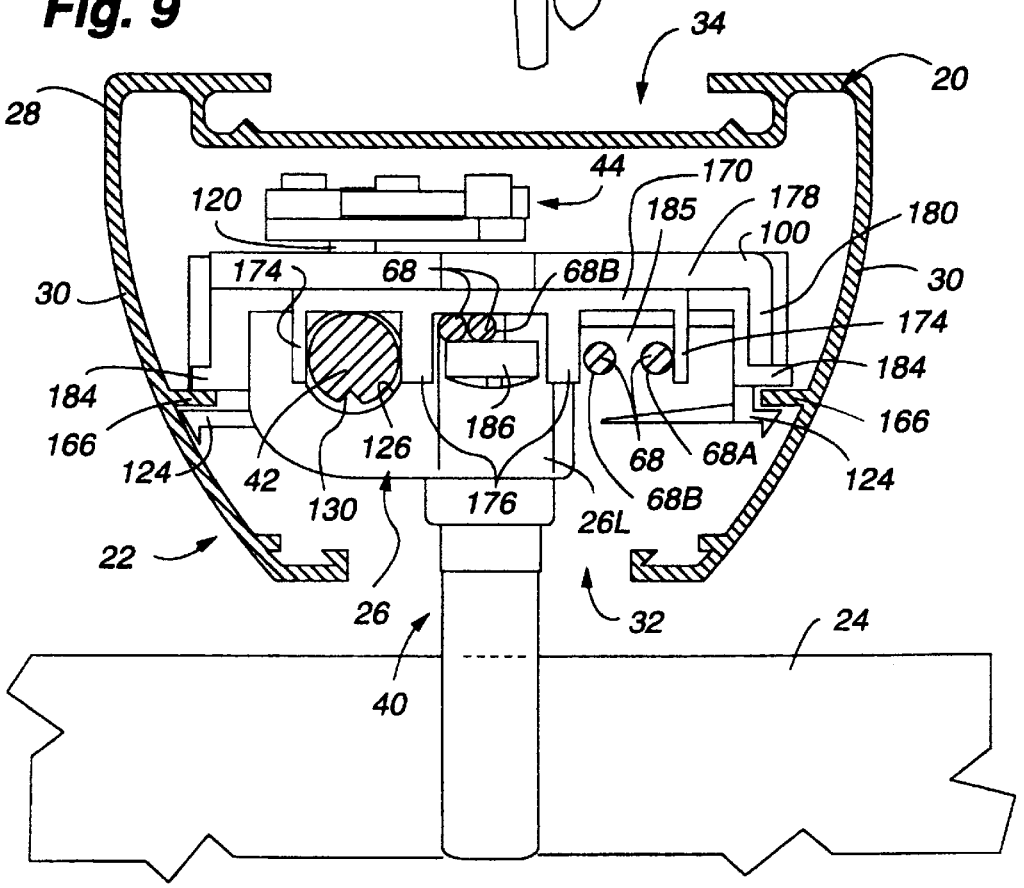

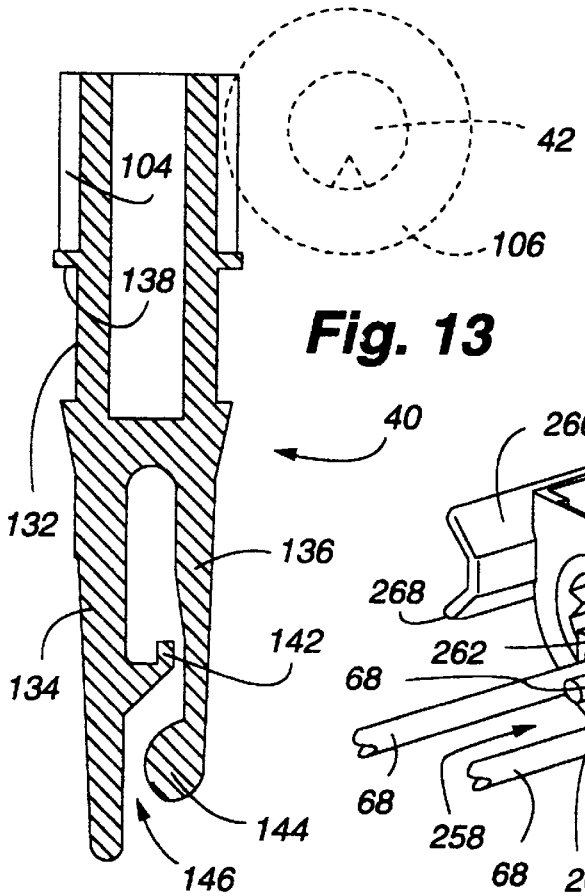
Fig. 13
Fig. 14
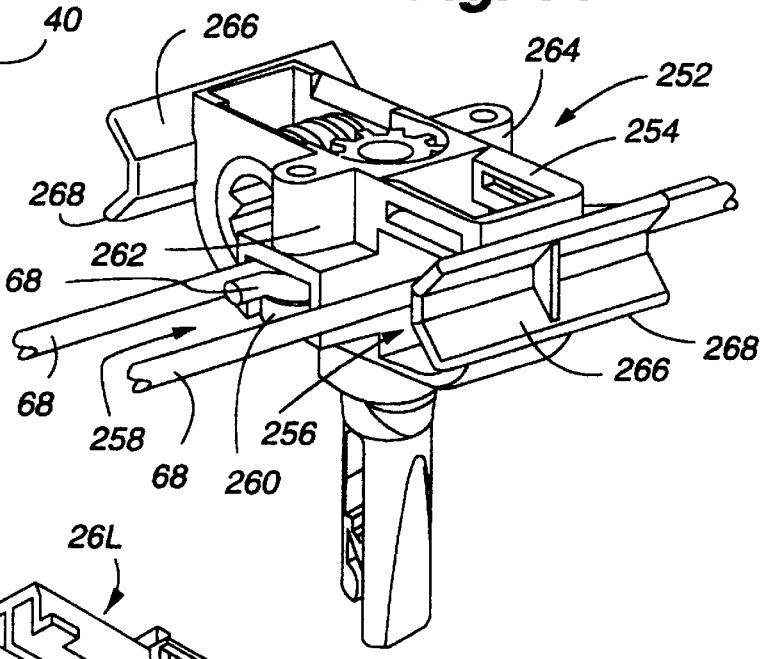
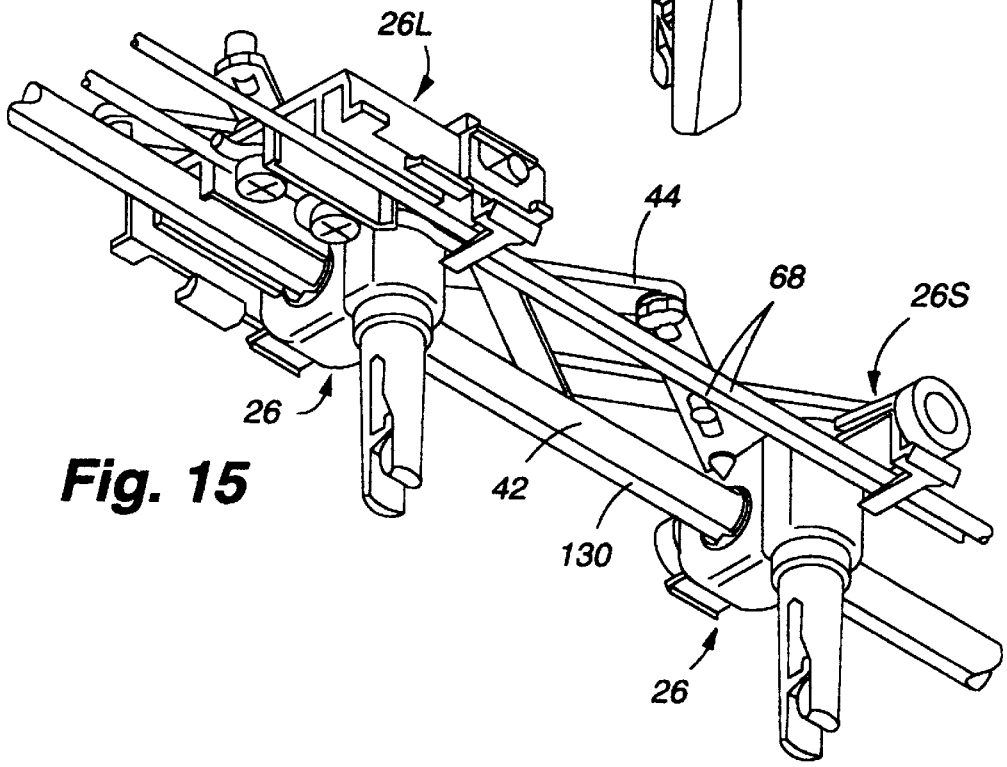
Fig. 15

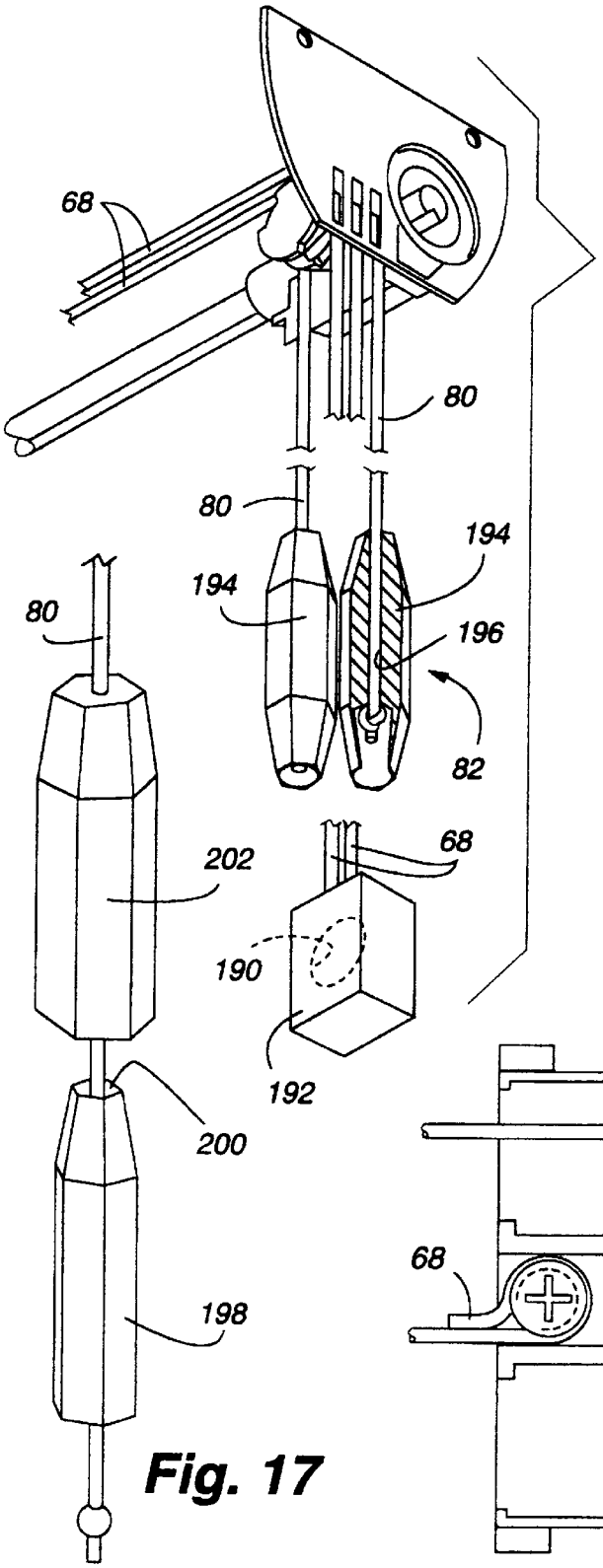
Fig. 16
Fig. 17
Fig. 20
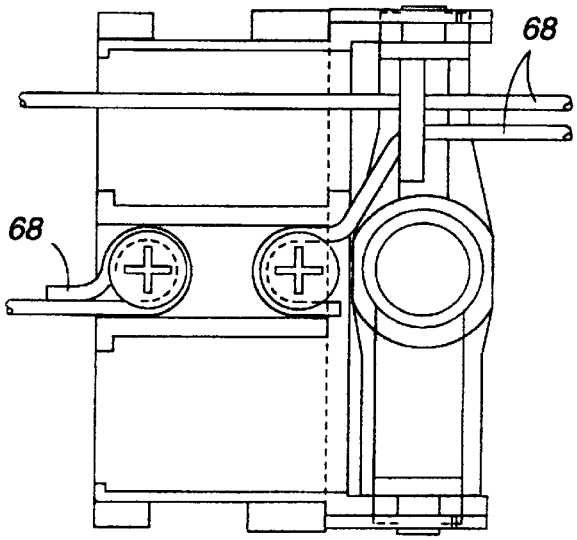

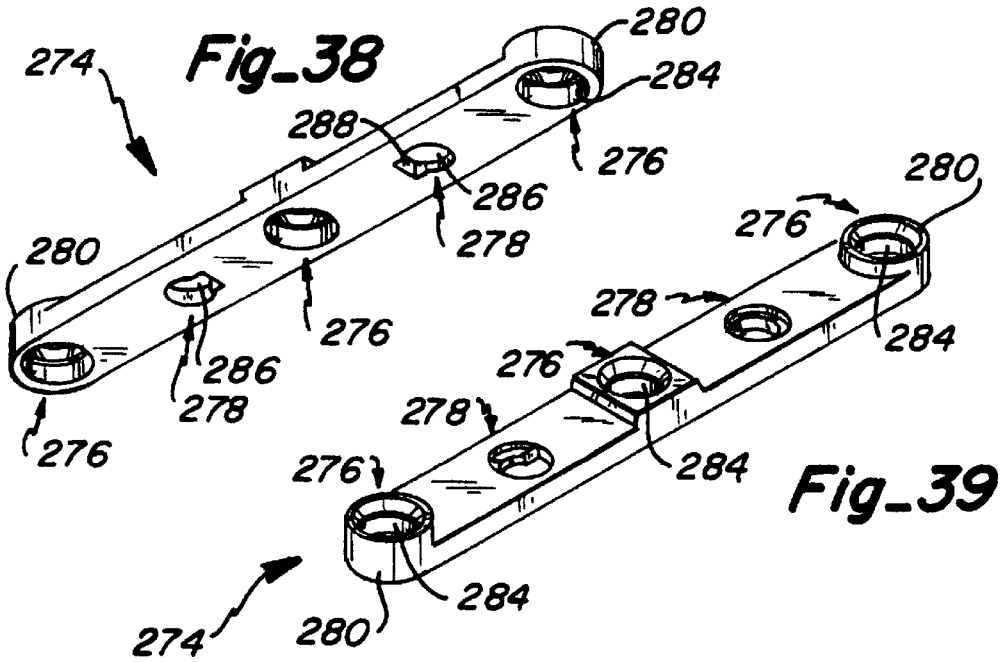
Fig_38
Fig_39
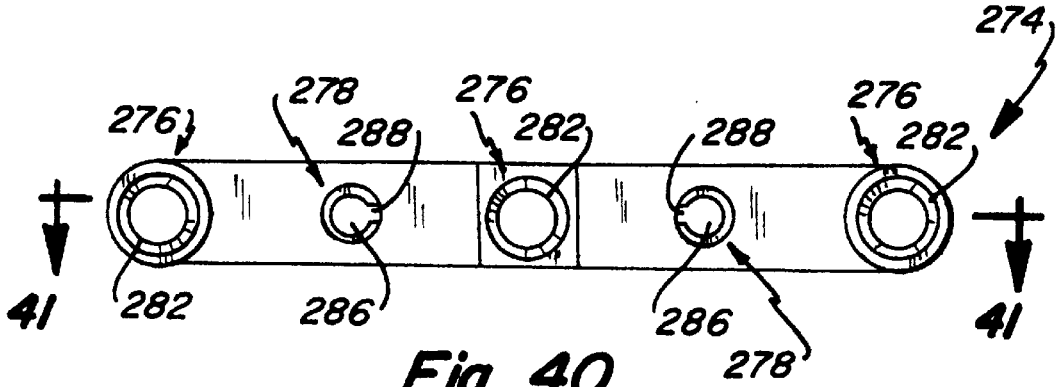
Fig_40
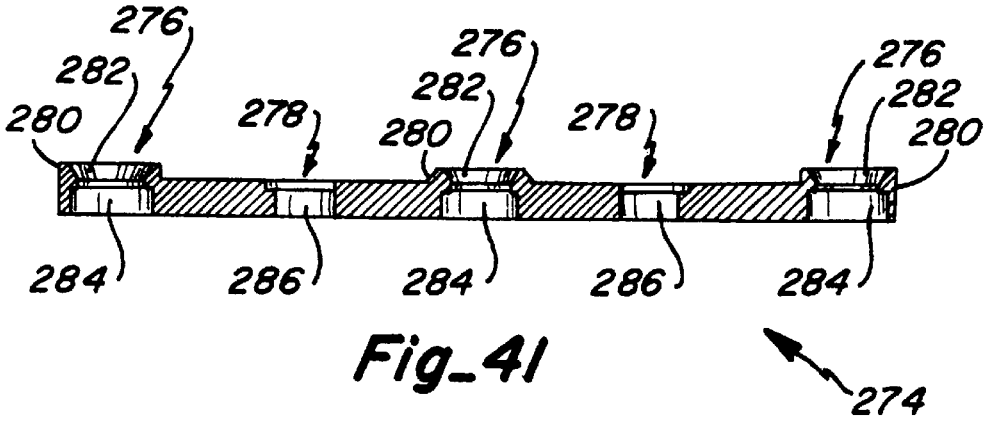
Fig_41

Fig_68
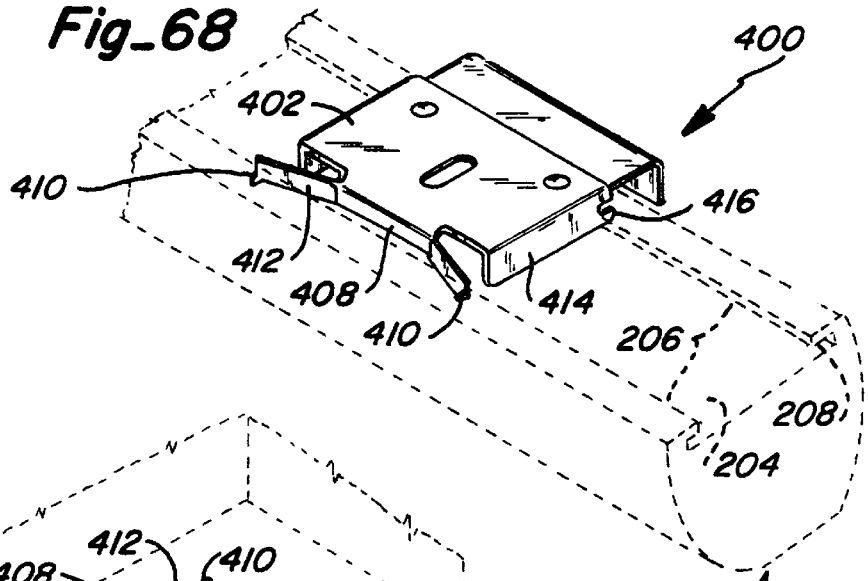
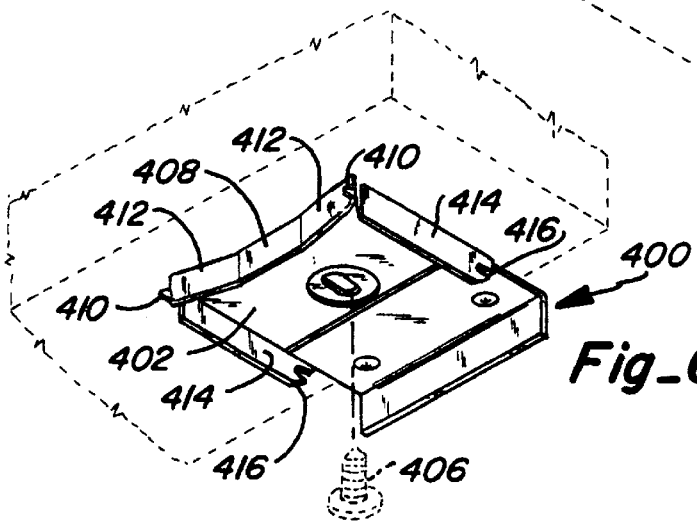
Fig_69
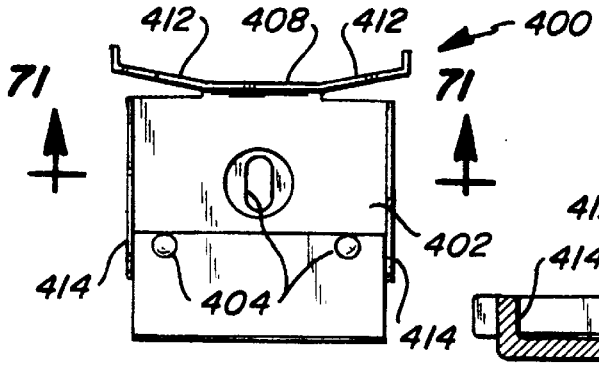
Fig_70
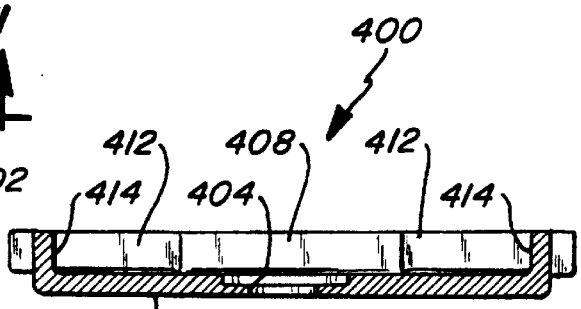
Fig_71

CONTROL SYSTEM FOR A VERTICAL VANE COVERING FOR ARCHITECTURAL OPENINGS

CROSS-REFERENCE TO RELATED APPLICATIONS

This application is a continuation-in-part of U.S. application Ser. No. 08/724,576 filed Sep. 30, 1996, and related to U.S. provisional application Serial No. 60/047,075 filed May 19, 1997.

BACKGROUND OF THE INVENTION

1. Field of the Invention

The present invention relates generally to coverings for architectural openings such as doors, windows, and the like, and more particularly to a control system for a covering having a plurality of vertically suspended vanes linearly movable between extended and retracted positions, as well as pivotally movable between open and closed positions, to control visibility and the passage of light through the architectural opening.

2. Description of the Relevant Art

Covers for architectural openings such as doors, windows, and the like have been known in various forms for many years. One form of such covering is commonly referred to as a vertical vane covering wherein a control system suspends and is operable to selectively manipulate a plurality of vertically suspended vanes such that the vanes can be linearly moved laterally across the architectural opening to extend or retract the covering and can be pivoted about longitudinal vertical axes to open and close the vanes.

Control systems for operating vertical vane coverings typically include a headrail in which a plurality of carriers associated with each vane are mounted for lateral movement, and include internal mechanisms for pivoting the vanes about their vertical axes. The headrails vary in construction and configuration to house the various types of carriers, but typically the headrails are relatively large and rectangular in cross section to enclose the working components of the system. Many such headrails have a slot along a bottom wall through which a portion of each carrier protrudes for connection to an associated vane.

Most control systems include pull cords that are operably connected to the carriers to shift or linearly move the carriers horizontally along the headrail and across the architectural opening. Control systems also usually include a horizontally disposed tilt rod operably connected to each carrier such that rotational movement of the tilt rod about its longitudinal axis transfers corresponding movement to the carriers and subsequently to the vanes to effect pivotal movement of the vanes about their longitudinal vertical axes. The tilt rod is typically rotated by a pull cord or a tilt wand that can be grasped by an operator of the system.

Considerable attention has been given to the configuration and construction of headrails as they are readily visible in vertical vane coverings. U.S. Pat. No. 4,361,179 issued to Benthin, for example, discloses a headrail having an opening through the top thereof so as to improve the aesthetics of the headrail. The primary components of each carrier in the system are confined within the interior of the headrail and generally "C" shaped hangers associated with each carrier circumscribe the headrail so as to be in a position to support an associated vane from beneath the headrail.

Carriers in vertical vane coverings may be interconnected by a pantograph so that movement of an endmost or lead carrier causes all of the carriers to move correspondingly. One problem with prior art control systems has been the manner in which the carriers are connected to the pantograph. Typically, due to the central connection system and expansion of the pantograph upon movement of the lead carrier, the other carriers are caused to skew slightly resulting in increased friction and making them more difficult to move along the length of the tilt rod.

Another shortcoming in prior art systems which utilize pull cords to move the lead carrier is the fact that the pulleys for returning and deflecting the pull cords are normally relatively small in size thereby requiring multiple revolutions to allow significant movement of the carriers which increases system friction and imposes unnecessary wear on the system.

Another problem with prior art control systems resides in the fact that they are difficult to assemble inasmuch as the drive mechanism of the carriers associated with the vanes must be uniformly aligned and operably connected to the tilt rod so that pivotal movement of the tilt rod moves the vanes between associated and corresponding angular positions. Accordingly, if the carriers are not mounted on the tilt rod uniformly, the vanes will not be properly aligned and uniformly angularly related to the architectural opening. As will be appreciated, in order to properly align and uniformly angularly relate the vanes to the architectural opening, the carriers have to be carefully and uniformly mounted on the tilt rod, which can be a time consuming endeavor.

Still another prevailing problem with prior art control systems for vertical vane coverings resides in the fact that the vanes are suspended in spaced relationship from the bottom of the headrail thereby establishing a gap that allows undesired light to pass between the top edge of the vanes and the bottom of the headrail. While the window covering itself may adequately block the passage of light through the architectural opening, this spaced relationship of the top edge of the vanes with the headrail undesirably permits the passage of light through the gap.

Since the pull cords utilized to move the lead carrier along the length of a tilt rod apply a significant force to the lead carrier which, in turn, expands or contracts the pantograph to effect corresponding movement of the other carriers, it will be appreciated that a skewing of the lead carrier can also be a problem depending upon the spacing of the pull cords from the tilt rod on which the carriers are mounted. Skewing of the lead carrier which increases drag on the system has traditionally also been a problem in prior art systems.

As will be appreciated from the above, drag in a control system resulting from friction between the various relatively movable parts has been a drawback. Accordingly, a need exists in the art for a low friction system that is easy to operate and is more durable for extended maintenance-free operation.

Another shortcoming in many prior art systems relates to the design of the headrail. The design and configuration of the headrail, as may not be readily appreciated, can create problems for an installer of vertical vane coverings. Many headrails used in vertical vane coverings are non-symmetric in transverse cross section in order to accommodate in a compact manner the working components of the associated control system. Examples of such headrails are disclosed in U.S. Pat. No. 5,249,617 issued to Durig, U.S. Pat. No. 4,381,029 issued to Ford, et al., and U.S. Pat. No. 4,381,029 issued to Ford, et al. While such systems may compactly accept the associated components of the control system, they are many times undesirable from an installation standpoint as they can only be installed in one orientation. If a headrail is blemished or marred, for example, on an outer visible surface, it is usually deemed unusable.

It is to overcome the aforenoted shortcomings in the prior art systems that the present invention has been developed.

SUMMARY OF THE INVENTION

The control system of the present invention is adapted for use in a covering for an architectural opening wherein the covering includes a plurality of vertically suspended vanes adapted to be uniformly disposed across the architectural opening or selectively retracted to one side of the opening. The control system is also adapted to selectively pivot the vanes about longitudinal vertical axes of the vanes so as to move the vanes between an open position wherein they extend perpendicularly to the architectural opening and in parallel relationship with each other, and a closed position wherein they lie parallel with the architectural opening and in substantially overlapping coplanar relationship with each other.

The control system has been uniquely designed for ease of assembly by an installer of the system and for ease of operation by a user. As in most vertical vane systems, the system of the present invention includes an elongated tilt rod that is confined within and supported by a headrail for rotative movement about its longitudinal axis. The tilt rod is operatively connected to a plurality of carriers disposed along its length, each of which suspends a separate vane, and wherein the carriers include a gear system driven by the tilt rod and adapted to selectively pivot the suspended vanes about their longitudinal axes. The tilt rod has a longitudinal groove adapted to cooperate with a mating projection on a gear within each carrier so as to facilitate uniform connection of the tilt rod with each carrier such that the vanes can be moved in unison between corresponding angles relative to the architectural opening for desired operation of the system.

The carriers are slidably mounted on the tilt rod for movement along the length of the tilt rod and are operably interconnected by a pantograph or scissors-type connector so that linear movement of any carrier along the tilt rod effects corresponding movement of the remaining carriers so that the vanes are, in turn, slidably moved across the window covering in unison. A pull cord system for selectively expanding or contracting the pantograph to correspondingly expand or retract the vanes across the architectural opening includes a traverse cord that is suspended along one side of the covering for operation, and is operably connected through a pulley system to a lead carrier for expansion and contraction of the pantograph and, thus, the covering. The lead carrier is a carrier at one end of the assemblage of carriers, and is the carrier that has full movement from one side of the architectural opening to the other as the covering is expanded or retracted by the traverse cord. The lead carrier, as well as the remaining standard carriers, has been uniquely designed so that the traverse cord is connected to the lead carrier in very close proximity to the tilt rod so as to minimize skewing of the lead carrier relative to the tilt rod upon pulling forces being applied to the lead carrier by the traverse cord. The traverse cord is preferably an elongated cord that is rendered endless by connection of the two ends of the cord to the lead carrier.

The tilt rod has been coated with a low friction material to further facilitate easy sliding movement of the carriers along the tilt rod.

Each standard carrier is uniquely designed to include a pocket or passage through which the traverse cord can freely extend. In one embodiment the pocket has a flexible side wall so that the cord can be inserted into the pocket by flexing the flexible side wall, but the flexible side wall is resilient and naturally returns to its original position to retain the cord within the pocket. This arrangement prevents drooping cords as has been a problem with conventional control systems.

Each carrier, with the exception of the lead carrier, has a pair of rollers adapted to ride on tracks provided internally along the length of the headrail so that the carriers move substantially friction free along the headrail.

Each carrier has a pair of engaged gears with one gear being a worm gear mounted on the tilt rod for unitary rotation therewith, and the second gear being a pinion gear associated with a hanger pin from which a vane is suspended. The carriers have been designed so that the pantograph interconnection with the carriers is centered over the tilt rod so as to minimize skewing of the carriers on the tilt rod upon expansion and contraction of the pantograph.

Each hanger pin has a pair of depending legs adapted to capture a vane therebetween. The vane is provided with an opening near its upper edge and one leg of the hanger pin has a hook that is removably received within the aperture so that the vane is suspended from one leg of the hanger pin. The hanger pin itself is uniquely designed so that the leg which bears the weight of the vane is relatively large in comparison to the other confining leg in contrast to conventional systems. The confining leg, which does not have a weight bearing function but merely captures the vane to prevent inadvertent release, is relatively thin and the overall weight of the pin has accordingly been reduced. The reduction in weight of the pin, however, has been obtained while obtaining an increase in strength by desirably distributing the weight of the pin onto the weight bearing leg.

The headrail for the control system has been uniquely designed so as to be transversely symmetric so that it can be installed in either direction without affecting the appearance or operation of the system. The headrail has a longitudinal slot along a bottom wall, and retention grooves along either side thereof to support and retain a light blocking rail, which extends downwardly from the headrail in close proximity to the top edge of the suspended vanes so as to substantially block the passage of light between the bottom of the headrail and the top of the vanes.

The pulleys used in the pull cord system have a diameter that is large relative to pulleys used in conventional systems, which not only improves the durability of the pulleys as they do not rotate through as many revolutions during operation of the covering, but in addition make the covering easier to operate, which is desirable from the user's standpoint.

Other aspects, features, and details of the present invention can be more completely understood by reference to the following detailed description of a preferred embodiment, taken in conjunction with the drawings, and from the appended claims.

BRIEF DESCRIPTION OF THE DRAWINGS

FIG. 4 is an isometric view looking down on elements of the control system without the headrail and illustrating the connection of the pantograph to a plurality of carriers, and with the pantograph in a retracted position.

FIG. 5 is an isometric view looking down on the pantograph and interconnected carriers with the pantograph in an expanded position, and with the tilt rod shown in dashed lines.

FIG. 8 is an enlarged section taken along line 8—8 of FIG. 2.

FIG. 9 is an enlarged fragmentary section taken along line 9—9 of FIG. 2.

FIG. 13 is a vertical section through a hanger pin showing the operatively engaged worm gear on the tilt rod shown in dashed lines.

FIG. 14 is an isometric view showing an alternative lead carrier for the system of the present invention.

FIG. 15 is a fragmentary isometric view of the lead carrier of the primary embodiment and a standard carrier mounted on the tilt rod and showing the pull cords and pantograph operatively connected therewith.

FIG. 16 is a fragmentary isometric view showing one end of the control system and weighted tassels for operating the control cords.

FIG. 17 is a fragmentary isometric view showing an alternative weighted tassel with the core separated from the outer shell.

FIG. 20 is a bottom plan view of the preferred embodiment of the lead carrier.

FIG. 38 is an isometric view of the bottom of the female link of the pantograph of FIG. 34.

FIG. 39 is an isometric view looking at the top of the female link of FIG. 38.

FIG. 40 is an enlarged top plan view of the female link of FIG. 38.

FIG. 41 is a longitudinal section taken along line 41—41 of FIG. 40.

FIG. 68 is an isometric view looking down from the top of an alternative bracket for supporting the headrail of the control system of the present invention from a supporting surface and with the headrail shown in phantom lines.

FIG. 69 is an isometric view looking up from the bottom of the bracket shown in FIG. 68 with a support for the bracket being shown in phantom lines.

FIG. 70 is a bottom plan view of the bracket shown in FIG. 69.

FIG. 71 is an enlarged section taken along line 71—71 of FIG. 70.

DESCRIPTION OF THE PREFERRED EMBODIMENTS

Figure 1:
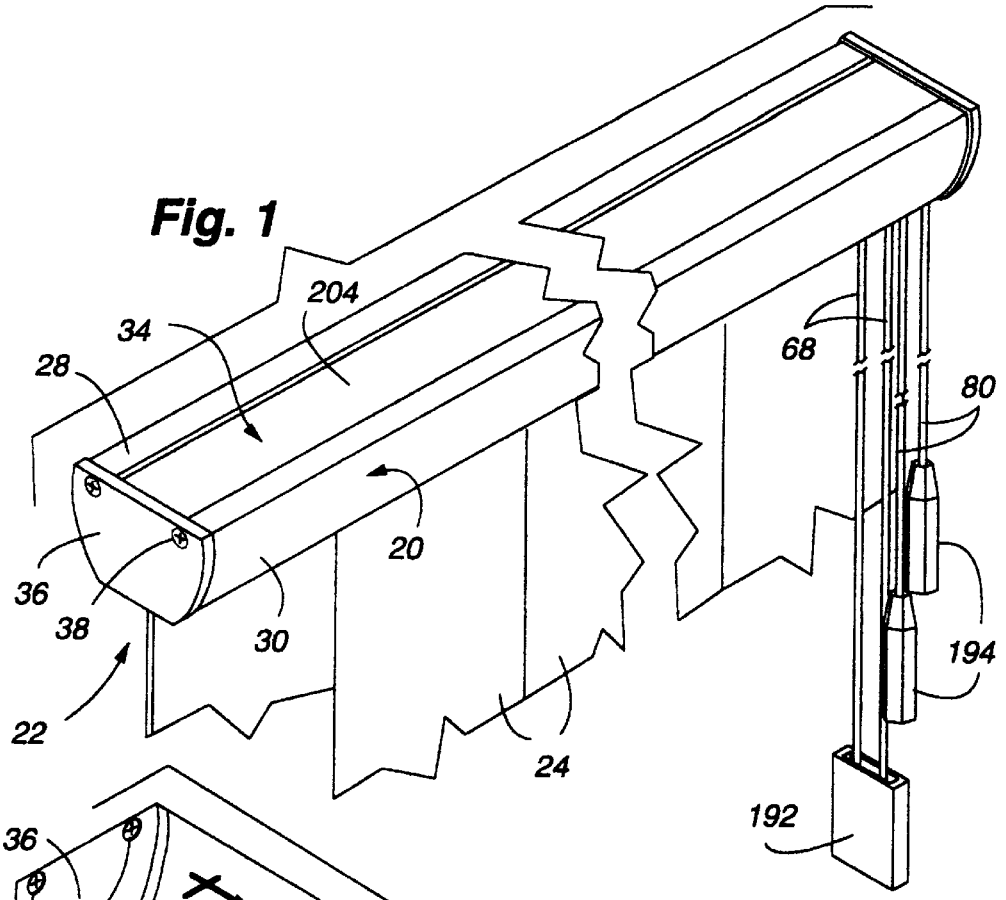
FIG. 1 is a fragmentary isometric view looking down on the control system of the present invention in use in connection with a covering for an architectural opening.
Figure 2:
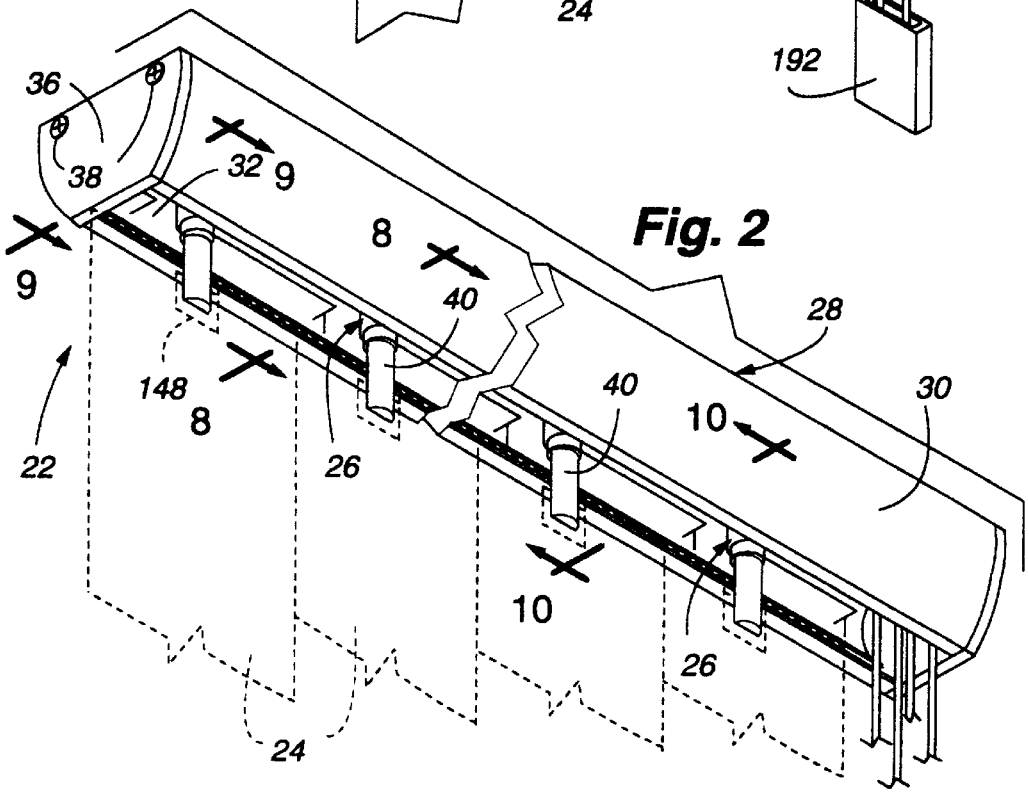
FIG. 2 is a fragmentary isometric view similar to FIG. 1 looking upwardly at the control system.

The headrail 20 and other portions of the control system 22 of the present invention are shown in FIGS. 1 and 2 with vertical covering segments, hereafter referred to as vanes 24 but which might assume other configurations, being suspended from carriers 26 in the system in adjacent side by side relationship. For purposes of clarity, the vanes are shown in dashed lines in FIG. 2. The headrail for the control system is designed to extend completely across the top of an architectural opening (not shown), and be suspended in a manner to be described hereafter from a beam or other supporting structure at the top of the architectural opening. While not being illustrated, the control system 22 is adapted to move the vanes 24 from a retracted position wherein the vanes are horizontally stacked adjacent one side of the architectural opening to an extended position wherein the vanes are evenly distributed across the architectural opening. In the extended position the vanes are adapted to be pivoted about longitudinal vertical axes between open positions wherein they extend perpendicularly to the architectural opening and in parallel spaced relationship to a closed position as illustrated in FIGS. 1 and 2, with the vanes overlapping and being substantially coplanar with each other.

The headrail 20, as can be appreciated in FIGS. 1 and 2, is symmetric relative to a longitudinally extending vertical plane bisecting the headrail or, in other words, is symmetric in a transverse direction relative to the vertical plane. The headrail, as probably best seen in FIG. 3, has a main body 28 with arcuate downwardly convergent side walls 30 that are spaced at the top and bottom so as to define an open longitudinally extending slot 32 in the bottom and a longitudinally extending relatively broad groove 34 in the top. End caps 36 are securable with suitable fasteners 38 to each end of the main body for closure purposes.

The slot 32 in the bottom of the headrail 20 permits hanger pins 40, forming part of the carriers 26 to protrude downwardly from the headrail and thereby suspend in a manner to be described later associated vanes 24 at a spaced distance beneath the headrail. Control cords forming part of an operating system also depend through the open slot at one end of the headrail as will be appreciated from the description that follows.

Figure 6:
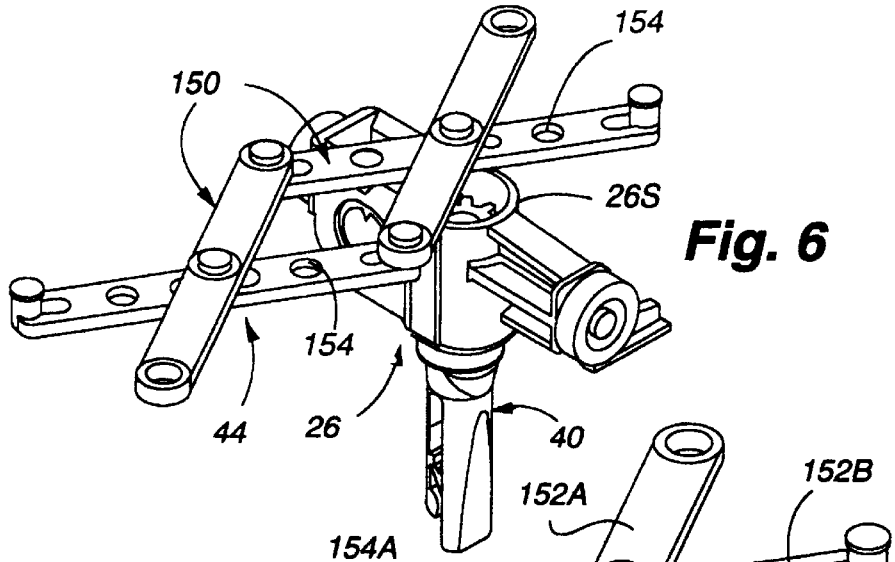
FIG. 6 is an isometric view showing the connection of the pantograph with a single carrier.

In addition to the headrail 20, the control system 22 includes an elongated, horizontally extending tilt rod 42 (FIG. 3) with a cord operated system for rotating the tilt rod about its longitudinal axis, a plurality of the aforenoted carriers 26 which are slidably mounted on the tilt rod and operatively associated therewith for pivoting the vanes about longitudinal vertical axes, and a pantograph 44 interconnecting the carriers such that movement of a lead carrier 26L (FIG. 15) along the length of the tilt rod by a pull cord mechanism causes each of the standard carriers 26S to follow in desirably spaced relationship with each other. The pantograph, which forms part of an operating system with the pull cords and the tilt rod for manipulating the carriers, is probably best illustrated in FIGS. 6 and 7.

Figure 3:
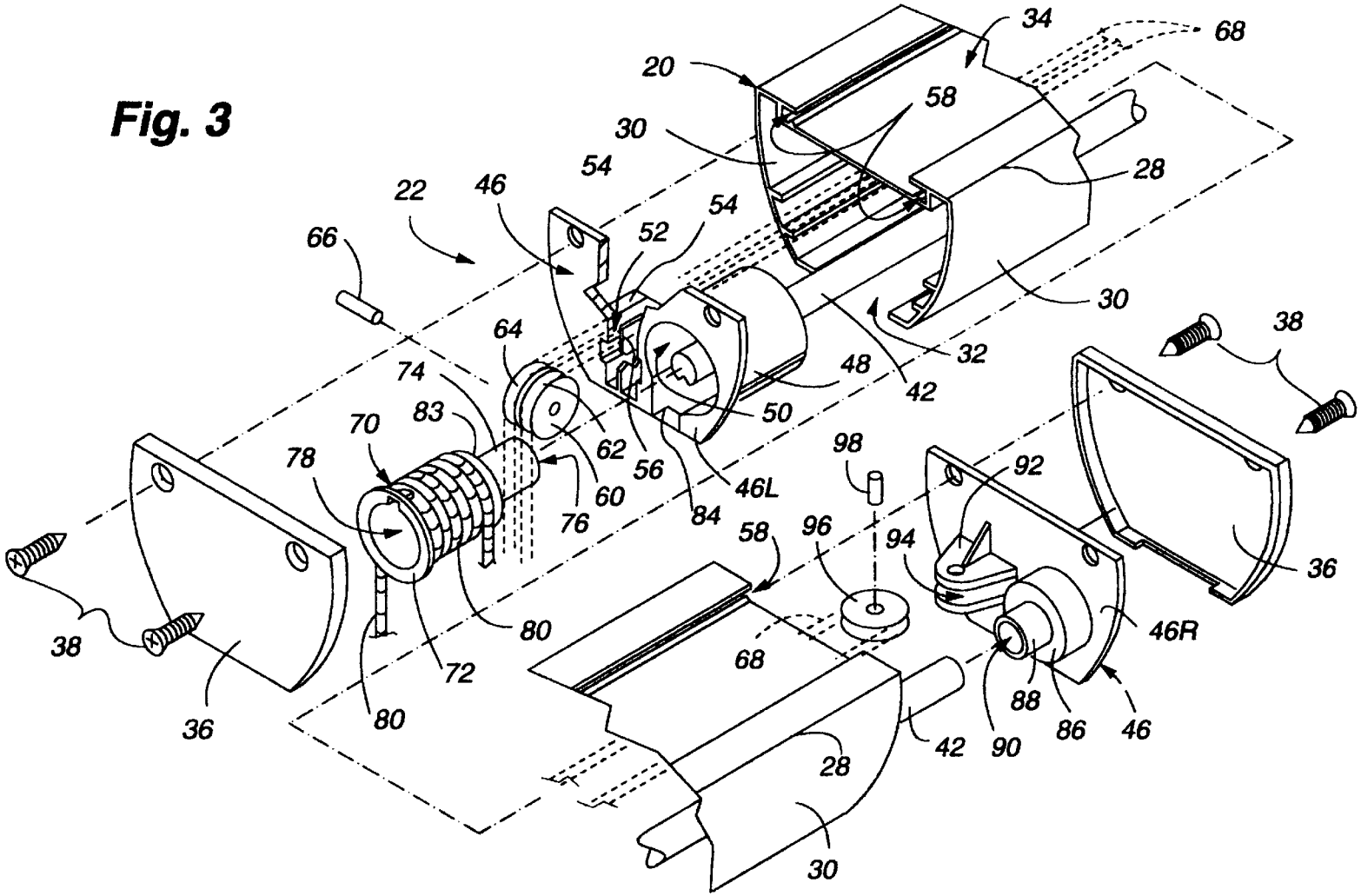
FIG. 3 is an exploded fragmentary isometric view illustrating the internal operational components of the control system with the carriers having been eliminated.

With reference to the exploded view in FIG. 3, the headrail 20 is illustrated with the end caps 36 having been removed from opposite ends thereof. Mounting plates 46 are securable to the end caps and are shown being properly positioned for supporting the operative components of the controls for pivoting the tilt rod 42 about its longitudinal axis, and for selectively expanding and retracting the pantograph 44. More specifically, at the left end of the headrail a mounting plate 46L is illustrated having a substantially cylindrically shaped bearing 48 with a cylindrical passage 50 therethrough. Adjacent to the cylindrical passage is a substantially "H" shaped slot 52 formed in a thickened section 54 of the mounting plate, with the slot 52 having a divider plate 56. The mounting plate 46 in cross section is identically shaped to the end cap, and is securably mounted thereto with the screw-type fasteners 38 that pass through openings in the mounting plate and are threadedly received in channels 58 formed in the main body of the headrail.

A dual pulley 60 with independently movable individual pulley segments 62 and 64 (as best seen in FIG. 3) is mounted in the H-shaped slot 52 in a vertical orientation and rotatably maintained in the slot by a pivot pin 66 that extends through the thickened section 54 on the mounting plate in which the H-shaped slot is formed to retain the dual pulley within the slot. The dual pulley, as will be described in more detail later, receives a traverse cord 68 used to move the carriers 26 along the length of the headrail.

The cylindrical passage 50 in the bearing 48 rotatably receives a barrel-shaped insert 70 (FIG. 3) having a large diameter portion 72 and a smaller diameter portion 74. The insert is hollow defining a relatively small diameter opening 76 through the smaller diameter portion 74 and a larger diameter opening 78 in the large diameter portion 72 of the insert. The smaller diameter opening 76 is adapted to slidably receive, but substantially conform in configuration and dimension with, one end of the tilt rod 42 so as to receive and support the end of the tilt rod for unitary rotation therewith. The large diameter portion 72 of the barrel insert defines a drum around which a tilt cord 80 extends. The tilt cord is wrapped around the drum to prevent slippage and so that the opposite ends of the cord 80 (FIG. 16), which depend from the drum, can be pulled to selectively rotate the drum about its longitudinal axis in either direction. The passage 50 through the cylindrical bearing 48 in the mounting plate 46L has large and small diameter portions to mate with the barrel insert so that the barrel insert is prevented from sliding through the bearing by a shoulder 83 (FIG. 3) on the barrel insert defined between the large and smaller diameter portions. The bearing on the mounting plate is slotted at 84 through the bottom so that both ends of the tilt cord 80 can hang therethrough.

Figure 24:
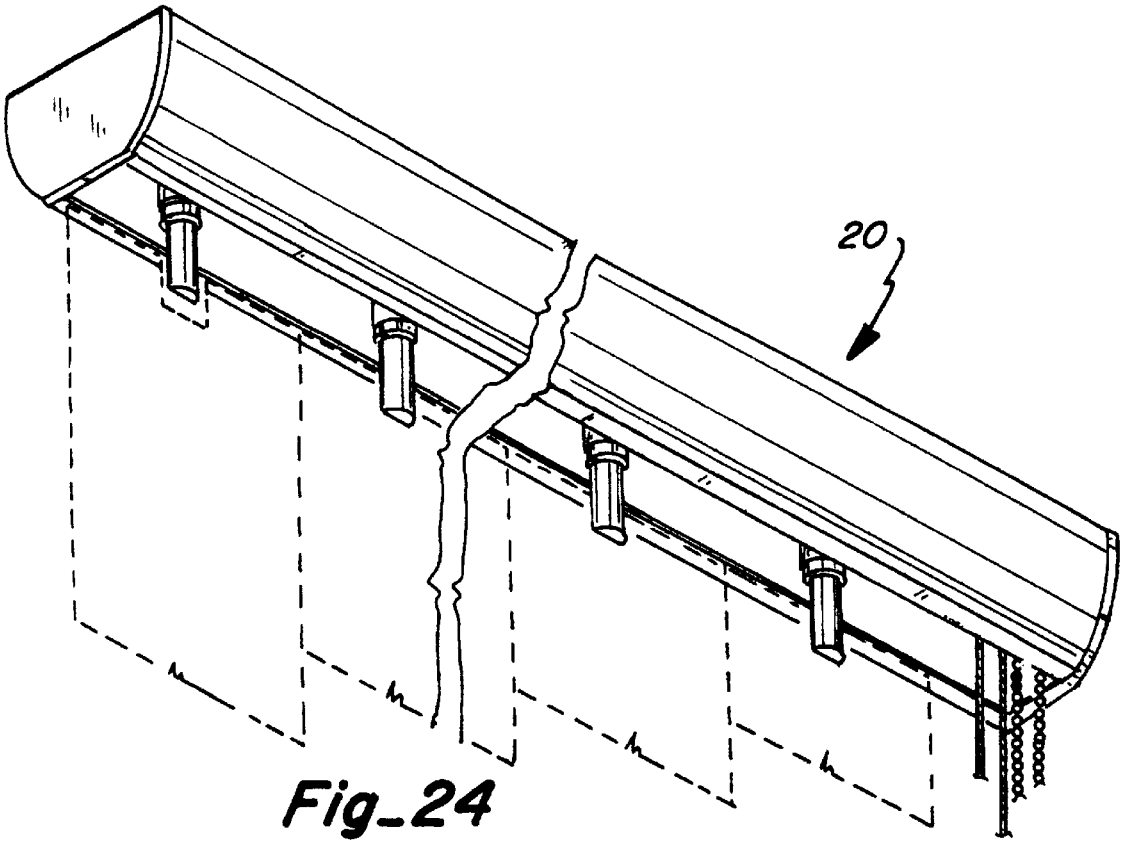
FIG. 24 is an isometric view of the control system of the present invention illustrating an alternative embodiment using a bead chain for tilting the vanes.
Figure 25:
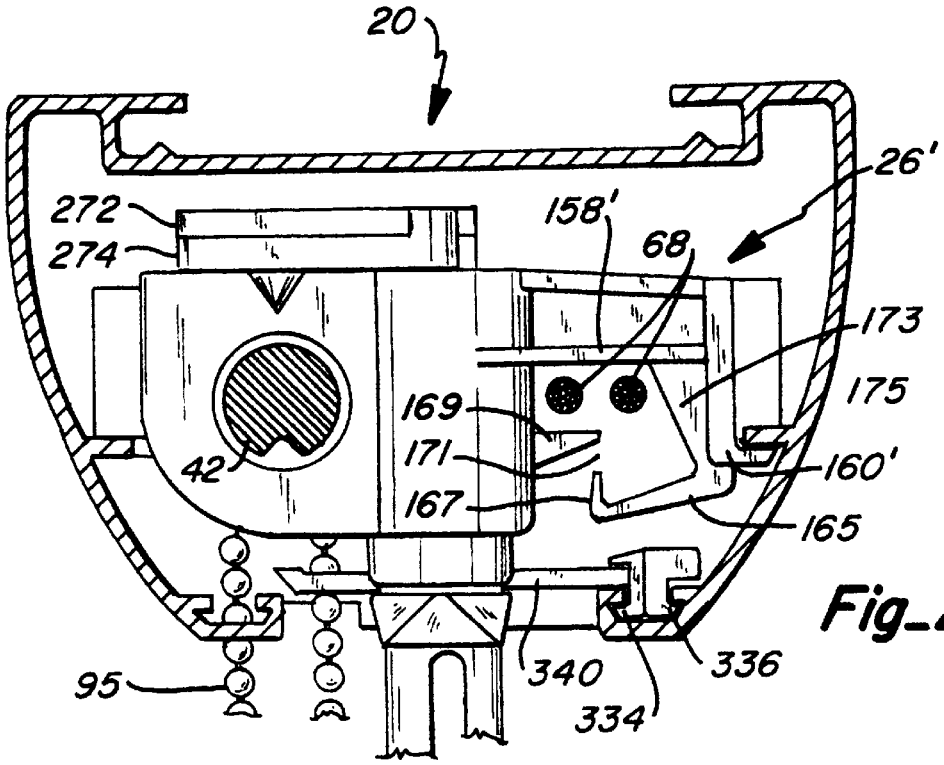
FIG. 25 is an enlarged section taken through the headrail of FIG. 24 illustrating an alternative embodiment of a carrier in the control system.

An alternative form of the mounting plate is shown in FIGS. 21 through 25 and identified 46'. In the mounting plate 46', it can be seen to have an H-shaped slotted opening 85 to receive the dual pulley 60 in the same manner as described with the mounting plate 46. Again, the dual pulley supports the traverse cord 68 which is adapted to move the carriers and thus the suspended vanes across the architectural opening. Adjacent to the H-shaped slotted opening, a cylindrical bearing 87 projects from one side of the plate to rotatably receive and support one end of the tilt rod 42. The cylindrical bearing has an enlarged cylindrical cavity 89 coaxial therewith which opens on the opposite side of the mounting plate. The cylindrical cavity is adapted to rotatably support a bead wheel guide 91 which is keyed in any suitable manner to the end of the tilt rod for unitary rotation therewith. The bead wheel guide has a scalloped periphery defining a plurality of adjacent cups which are sized and adapted to releasably receive beads 93 of a conventional beaded chain 95. The interaction of the beads with the cups in the periphery of the bead wheel guide allows longitudinal movement of the beaded chain to rotate the bead wheel guide and consequently rotate the tilt rod about its longitudinal axis to pivot the vanes about their longitudinal axes as will be described in more detail later. The mounting plate 46' also has a pair of longitudinally extending fingers 97 on opposite sides adapted to be received in the end of longitudinal channels of the headrail to align the mounting plate with the end of the headrail. The mounting plate 46' is secured to the headrail as with the mounting plate 46 by the screw-type fasteners 38 that pass through openings in the end cap and the mounting plate to secure the mounting plate in place. The end cap, of course, also confines the bead wheel guide 91 within the cylindrical cavity 89. FIGS. 24 and 25 show the headrail with the beaded chain 95 in the control system and with the beaded chain (FIG. 24) hanging adjacent to the traverse cord at one end.

The opposite or right end of the headrail, as best seen in FIG. 3, similarly has a mounting plate 46R with a cylindrical bearing 86 having a reduced diameter cylindrical protrusion 88. The bearing 86 defines a cylindrical passage 90 therethrough adapted to rotatably receive the opposite end of the tilt rod 42 which is predominantly rigid but slightly flexible. A gusseted bracket 92 also projects inwardly from the mounting plate and has a horizontal slot 94 therein adapted to rotatably support a horizontal pulley 96 that rotates about a pivot pin 98 received in the bracket. Again, the mounting plate 46R is secured to the associated end cap 36 with screw-type fasteners 38 that are inserted into and threadedly received in the channels 58 at the opposite end of the headrail. The horizontal pulley 96 receives the traverse cord 68 which is preferably an elongated cord that is effectively rendered endless by its connection to the lead carrier 26L in a manner to be described later. Both the horizontal pulley 96 and the dual pulley 60 are of relatively large diameter (i.e. approximately 0.608 inches) in comparison to pulleys used in most conventional systems which has been found to make the system easier to operate and extends the life of the component parts.

As mentioned previously, there are a plurality of carriers 26 disposed along the length of the headrail and slidably mounted on the tilt rod 42 for pivotal movement of the vanes 24 suspended from the carriers. The carriers are uniform in construction with the exception of the lead carrier 26L which is, in the preferred embodiment and as best seen in FIGS. 9, 15, 19 and 20, merely a modification of a standard carrier 26S through the addition of a snap-on carrier plate 100. The lead carrier will be described in more detail later.

Figure 7:
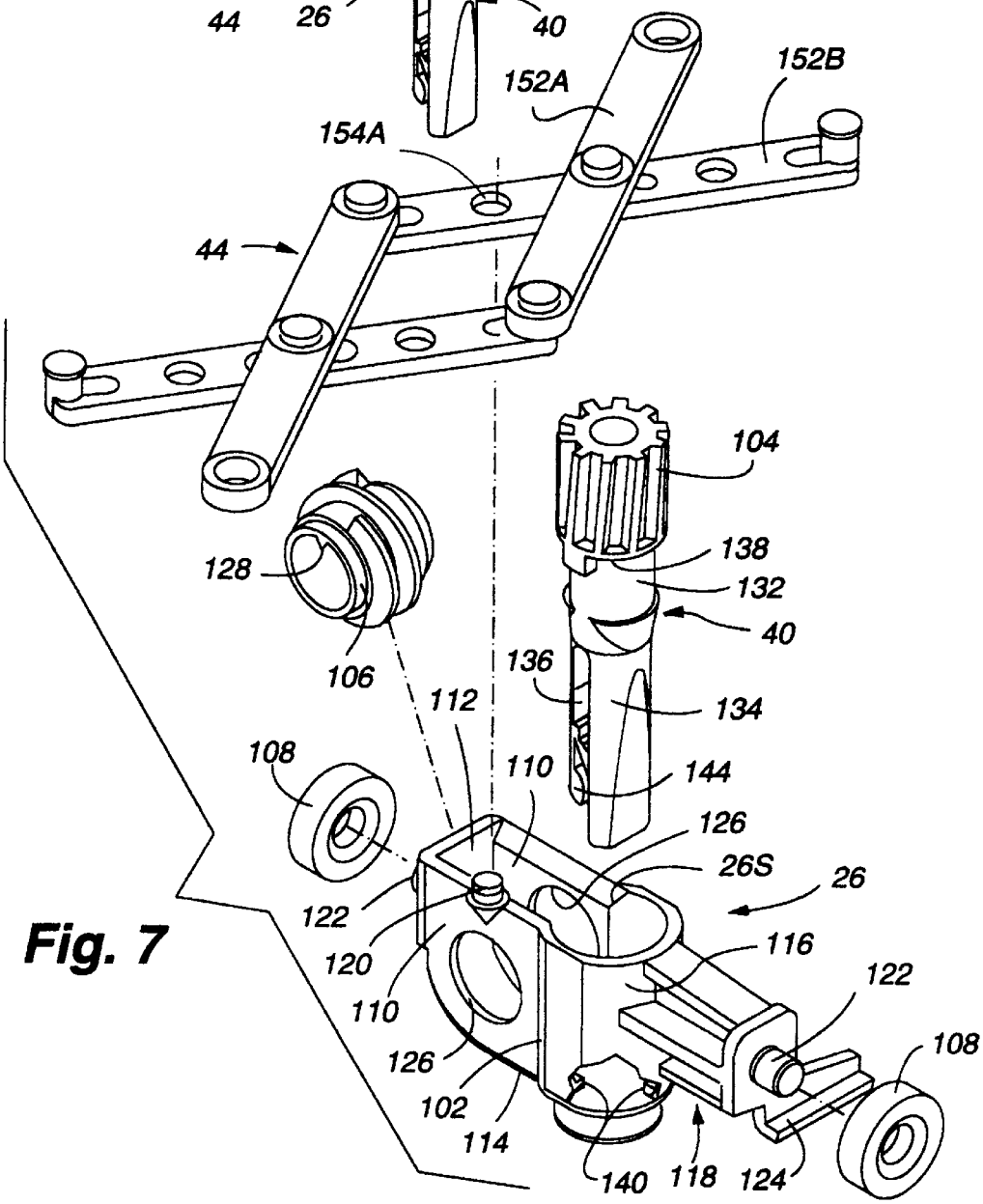
FIG. 7 is an enlarged exploded isometric view showing the connection of the pantograph with a single carrier.

Each carrier 26, probably best seen in FIG. 7, includes a main body 102, a hanger pin 40 having a pinion gear 104 on its uppermost end, a worm gear 106, and a pair of roller wheels 108. The main body is substantially hollow, having a pair of side walls 110, a flat end wall 112, a bottom wall 114, and an arcuate opposite end wall 116 from which a gusseted extension 118 forms a lateral extension. A connector in the form of a pivot pin 120 is formed on the top of one side wall 110 to enable attachment of the carrier to the pantograph 44. The gusseted bracket 118 and the flat end wall 112 each have stub shafts 122 formed thereon to rotatably receive an associated snap-on roller wheel 108. Mounted on the distal end of the gusseted bracket and on the flat end wall are horizontal slides in the form of substantially flat extension plates or ledges 124 (FIGS. 7 through 9) which cooperate with the associated roller wheels in guiding movement of the carrier along the headrail 20, as will also be explained hereafter.

Aligned circular openings 126 are provided through the side walls 110 in a vertical plane with the pivot pin 120, which are of a diameter substantially the same as the outside diameter of the tilt rod 42 so as to rotatably receive the tilt rod. The worm gear 106 is mounted on the tilt rod within the interior of the carrier and is keyed to the tilt rod with an inwardly directed generally V-shaped protrusion 128 (FIGS. 7 through 9) that is received in a longitudinally extending V-shaped groove 130 in the tilt rod. The worm gear, therefore, rotates in unison with the tilt rod.

The hanger pin 40, as best seen in FIGS. 7 and 13, is elongated and of generally cylindrical configuration defining the pinion gear 104 at its uppermost end, a central cylindrical body portion 132, and a pair of spaced depending legs 134 and 136 which are adapted to support the uppermost end of an associated vane 24. The hanger pin is pivotally mounted within the arcuate end wall 116 of the carrier body with a shoulder 138 at the lower end of the pinion gear being supported upon an inwardly directed rim (FIG. 7) projecting inwardly from the inner cylindrical wall of the arcuate section. The depending legs, therefore, protrude from the bottom of the main body.

Looking specifically at FIG. 13, one leg 134 of each hanger pin 40, which will be referred to herein as the supporting leg, has a hook shaped projection 142, and the body of the support leg is relatively thick in comparison to the other leg 136, which will be referred to as the confining leg. The confining leg 136 has a beaded lower end 144 so that a relatively thin channel 146 between the two legs opens downwardly to receive the uppermost edge of an associated vane 24 that has a transverse opening 148 (FIG. 2) therethrough adapted to be received upon and supported by the hook-shaped projection on the support leg. The confining leg urges the vane toward the support leg so that it does not inadvertently become released from the hanger pin. It is important to note that the confining leg, not having a supportive role, has been made relatively thin in comparison to the supporting leg thereby reducing the material used in the hanger pin. This reduction in material has been achieved while increasing the thickness of the supporting leg in comparison to conventional hanger pins so as to obtain approximately a 28% increase in strength while reducing the overall weight and cost of the pin. The average thickness of the supporting leg in the preferred embodiment is in the range of 0.095 to 0.105 inches, while the thickness of the upper end of the confining leg is in the range of 0.075 to 0.085.

When the hanger pin 40 is disposed within the main body, the pinion gear 104 is meshed with the worm gear 106 so that rotational movement of the worm gear about its horizontal axis effects pivotal movement of the hanger pin about its vertical axis. The tilt rod 42, which rotates the worm gear, thereby effects pivotal movement of the vane suspended from the hanger pin.

As mentioned previously, the pantograph 44 is a mechanism that operatively interconnects each carrier 26 so that movement of the lead carrier 26L causes a corresponding movement of the standard or following carriers 26S thereby uniformly distributing the vanes across the architectural opening or retracting the vanes adjacent to one side of the opening. The pantograph, as best seen in FIGS. 4 through 7, has a plurality of pivotally interconnected links 150 which are interconnected in a scissors-like manner. There are two sets of links 152A and 152B, with each set having a plurality of parallel links angularly related to the links of the other set. A link 152A of one set is pivotally connected at a midpoint to an associated link 152B of the other set, and the end of each link in a set is pivotally connected to the end of a link in the other set. One set of links 152B has a plurality of apertures 154 provided therethrough and one aperture 154A (FIG. 7) is offset from the center and substantially equally spaced or centered between the midpoint and one end of the link. The offset aperture is adapted to pivotally receive and be retained on the pivot pin 120 mounted on one side wall 110 of a carrier so that the link pivots about the pivot pin upon expansion or retraction of the pantograph. It is important to note and appreciate that the pivot pin 120 is vertically aligned with the tilt rod 42. In this manner, when the pantograph 44 is expanded or contracted causing the links to move longitudinally of the headrail 20, the force applied to the carrier 26 by the pantograph is along the tilt rod so that the carrier is not torqued or otherwise pulled in a manner that might cause the carrier to skew relative to the tilt rod. This connection causes a smooth gliding movement of the carriers along the tilt rod. To further improve the sliding movement, the tilt rod is preferably coated with a low friction material such as polyester so that there is a reduced resistance to movement of the carrier along the tilt rod.

As probably best seen in FIG. 8, the gusseted extension 118 on each standard carrier 26S is defined by an upper plate 156 and an intermediate plate 158 connected to the arcuate end wall 116 of the main body, as well as a vertical or distal end plate 160 interconnecting the distal ends of the upper and intermediate plates and protruding downwardly therefrom. The distal end plate 160 has one of the stub shafts 122 for the roller wheels 108 mounted on an outer face thereof and an inwardly projecting flexible horizontal finger 162 spaced downwardly from the intermediate plate 158. The flexible finger has a fixed end and a free end with the free end being spaced slightly, i.e. a distance slightly less than the diameter of the traverse cord 68, from the outer surface of the arcuate wall. It will be appreciated that a pocket or passage 164 is defined between the flexible finger 162, the intermediate plate 158, the outer surface of the arcuate end wall 116 and the distal end plate 160, which pocket is adapted to slidably receive and confine the traverse cord used in moving the carriers along the length of the headrail. The flexible finger is resilient so as to permit the cord to be inserted through the gap between the finger and the arcuate end wall, but the finger is rigid enough to retain the cord within the pocket after having been flexed so that if slack were to ever form in the cord, the cords would not droop from the pocket. In other words, the pocket confines the cord so that it will not distractively droop, for example, through the slot 32 formed in the headrail where it would otherwise be undesirably visible.

Figure 26:
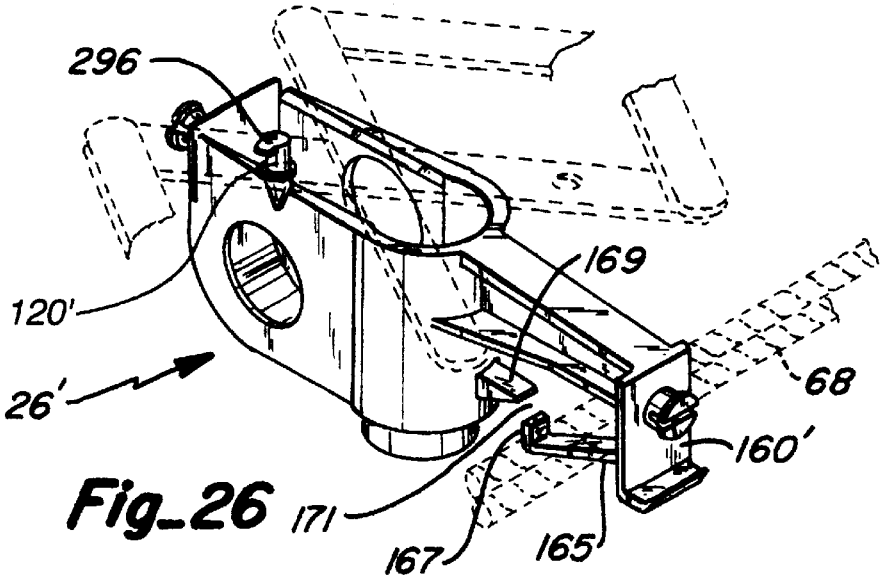
FIG. 26 is an isometric view of the alternative embodiment of the carrier with phantom line representations of the pantograph connected thereto and the traverse cord extending therethrough.
Figure 27:
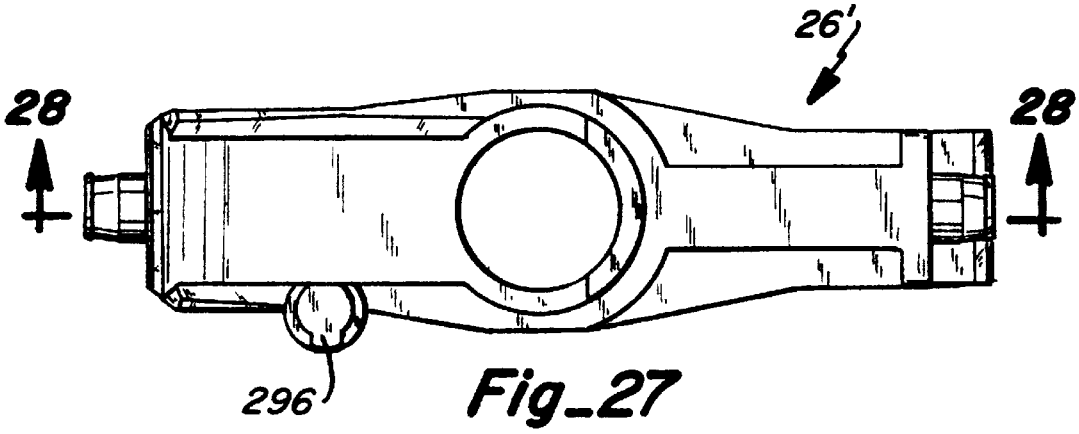
FIG. 27 is an enlarged top plan view of the carrier shown in FIG. 26.
Figure 28:
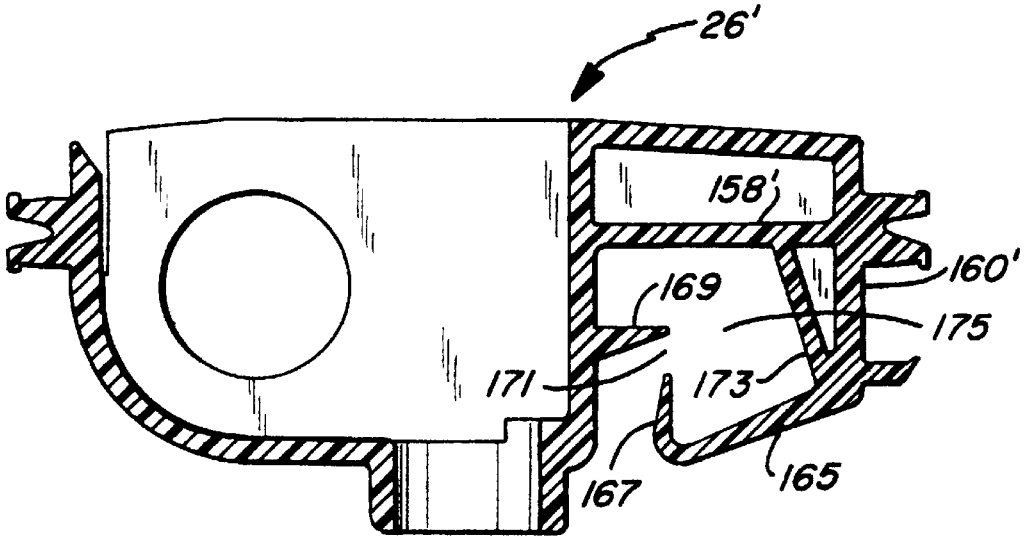
FIG. 28 is a section taken along line 28—28 of FIG. 27.
Figure 29:
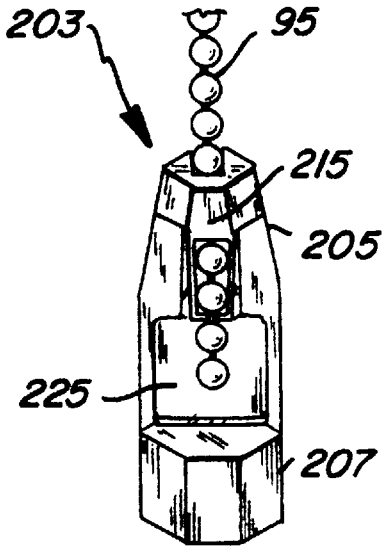
FIG. 29 is an isometric view of an alternative embodiment of a tassel for use in connection to a bead chain used in the control system of the present invention.
Figure 30:
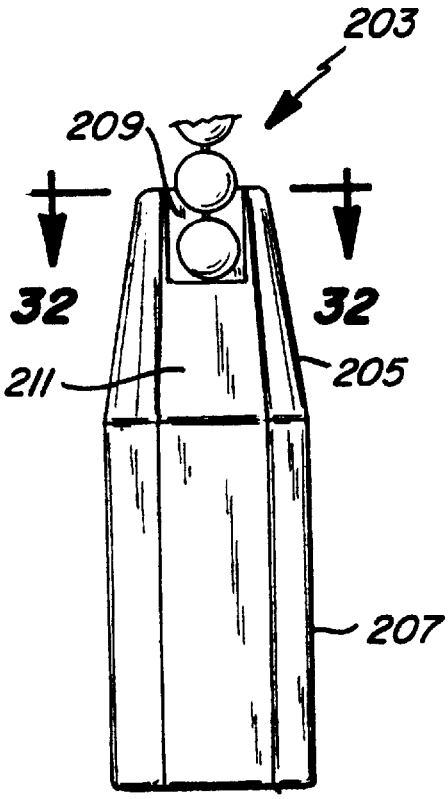
FIG. 30 is an enlarged front elevation of the tassels shown in FIG. 29.
Figure 31:
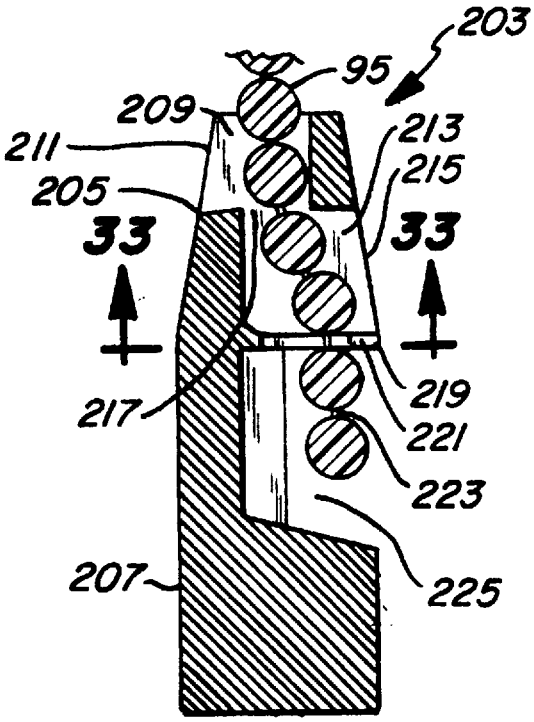
FIG. 31 is a vertical section taken through the tassel as shown in FIG. 30.
Figure 32:
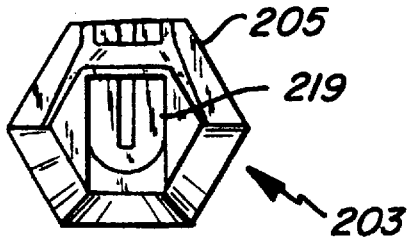
FIG. 32 is a view taken along line 32—32 of FIG. 30.
Figure 33:
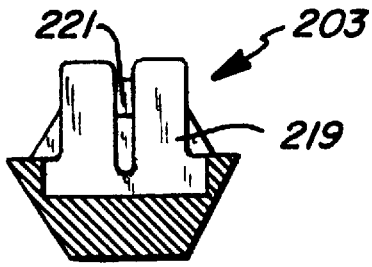
FIG. 33 is a section taken along line 33—33 of FIG. 31.

In an alternative form of the carrier identified by the reference number 26' and shown best in FIGS. 26 through 28, it will be seen that the carrier is identical to carrier 26 except that horizontal finger 162 of carrier 26 has been replaced with a downwardly angled finger 165 having a vertical lip 167 which underlies the tip of a horizontal finger 169 that projects away from the main body of the carrier. A small gap 171 is provided between the vertical lip 167 and the horizontal finger 169 through which the traverse cord 68 can be inserted. A reinforcing plate 173 interconnects the lower end of distal end plate 160' with intermediate plate 158' and cooperates with the intermediate plate, the angled finger and the horizontal finger in defining a pocket 175 which releasably confines the control cord to prevent it from drooping through the open bottom of the headrail.

With further reference to FIG. 8, it will be appreciated that the arcuate side walls 30 of the headrail 20 have inwardly directed substantially horizontal protrusions or tracks 166 formed near the vertical center of the headrail. The tracks are adapted to support the roller wheels 108 so that the carriers can roll along the length of the headrail when moved by the pantograph 44. The horizontal extension ledge 124 on the distal end plate 160 of each carrier 26 is spaced beneath the overlying roller wheel so as to accommodate an associated track on the headrail. The carrier is, therefore, confined on the tracks for movement therealong by guide elements in the form of the roller wheels 108 and slides 124 which stabilize the carriers relative to the headrail. Either the carrier or the tracks can be coated with a low friction material to facilitate an easy sliding movement of the carriers with polyester being a suitable coating for this purpose.

Figure 19:
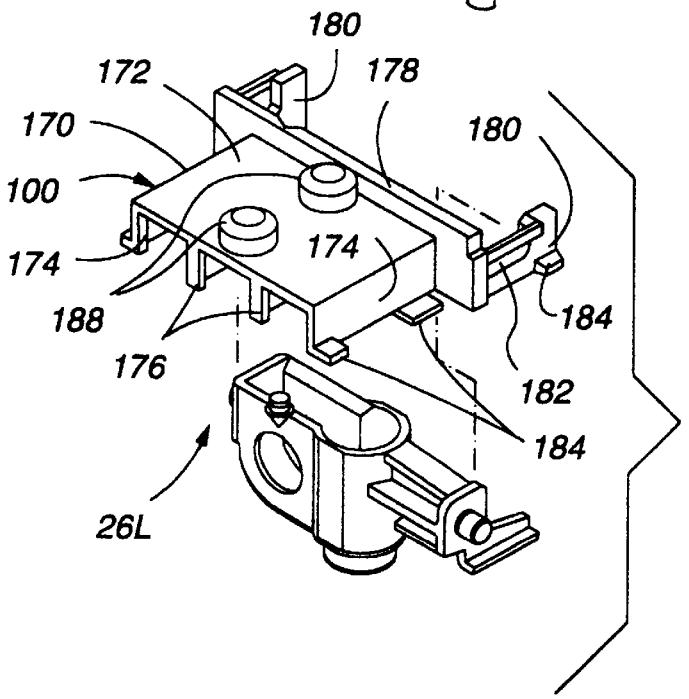
FIG. 19 is an exploded isometric view of the lead carrier in the primary embodiment showing the component parts of the lead carrier.
Figure 21:
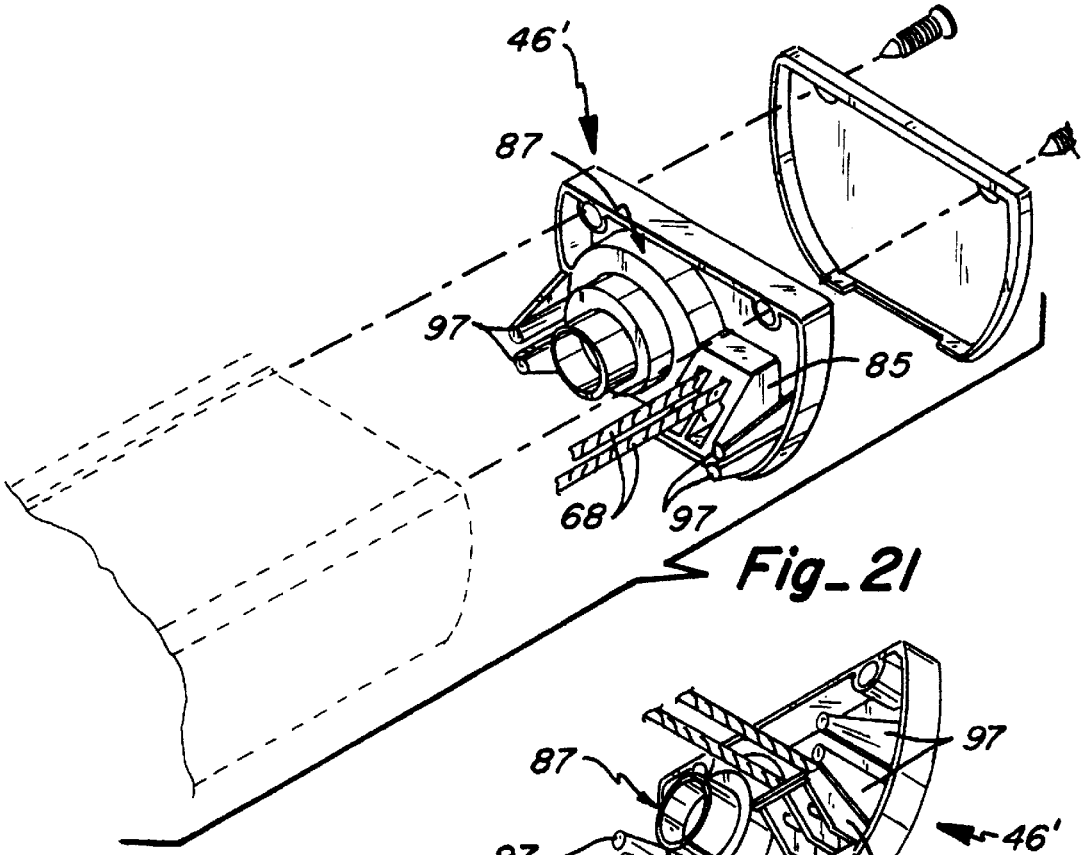
FIG. 21 is an exploded isometric view of an alternative mounting plate and end cap at one end of the headrail looking down on the headrail.
Figure 22:
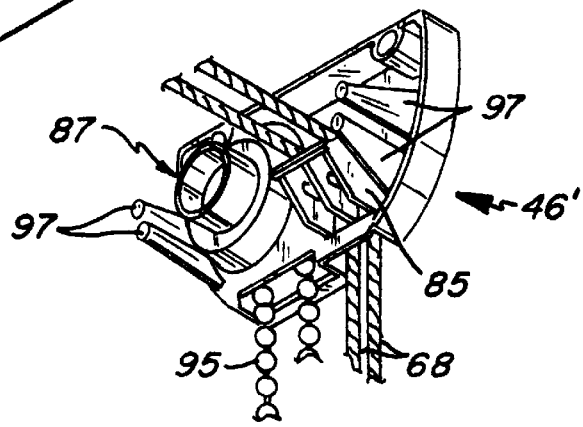
FIG. 22 is an isometric view looking up from the bottom of the mounting plate shown in FIG. 21.
Figure 23:
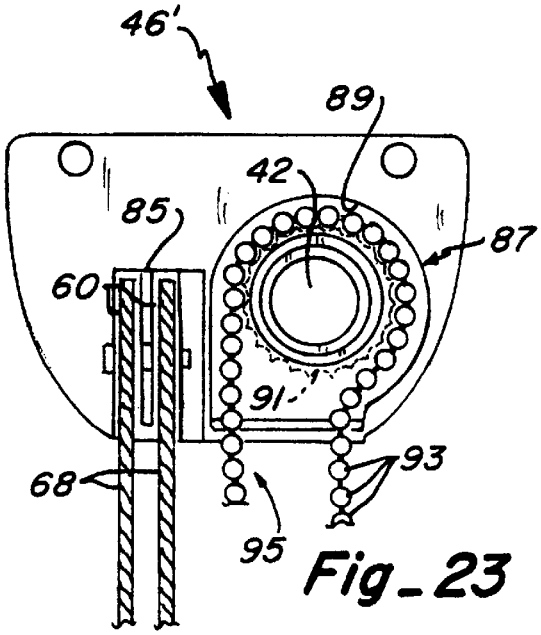
FIG. 23 is an enlarged end elevation showing the opposite side of the mounting plate as shown in FIG. 22.

In the primary embodiment of the present invention, the lead carrier 26L is merely a modified standard carrier 26S, as is probably best illustrated in FIGS. 9, 15 and 19. As is probably best seen in FIG. 19, the lead carrier 26L comprises a standard carrier 26S and the snap-on carrier plate or top bracket 100 which is releasably connected to the standard carrier. The top bracket 100 has a main body portion 170 defining a top plate 172, a pair of depending side plates 174, and a pair of depending intermediate plates 176, which extend in parallel with the length of the headrail 20. On one side of the main body portion, a generally U-shaped member 178 is formed which is slightly wider than the main body portion. On the horizontally extending legs 180 of the U-shaped member 178, elongated ovular horizontally oriented slots 182 are provided to releasably receive the stub shafts 122 on which the roller wheels 108 are mounted for the standard carrier 26S. In other words, on the lead carrier 26L, the roller wheels are either removed or not fitted and the stub shafts are snapped into the slots 182 on the horizontal legs of the bracket, which are resilient enough to allow the insertion of the stub shafts. Along the bottom edge of the legs 180 and the bottom edge of the side plates 174 are slides in the form of lateral, flat, plate-like protrusions 184 which are adapted to overlie the tracks 166 while the horizontal ledge 124 on the standard carrier body underlies the track of the headrail. In this manner, the lead carrier is confined for sliding movement along the tracks similarly to the standard carriers and, again, a coating of polyester or the like on the tracks provides a desirable low friction surface to facilitate an easy sliding movement.

As probably best illustrated in FIG. 9, the space between a side plate 174 and an intermediate plate 176 on the main body portion 170 of the top bracket 100 of the lead carrier 26L defines a downwardly opening channel 185 in which segments of the traverse cord 68 are aligned. The outermost segment 68A of the traverse cord passes through this channel 185, while the innermost segment 68B of the cord is diverted so as to extend between the two intermediate plates 176 where that particular cord segment 68B, which defines one end of the traverse cord, is secured to the lead carrier by a screw-type fastener 186 which is threaded from beneath into a boss 188 provided on the top plate. The outermost segment 68A of the cord which passes through the channel 185 extends to the far end of the headrail where it passes around the horizontal pulley 96 and returns with the opposite end of the traverse cord 68 being secured to the lead carrier 26L by the second one of two screws, FIG. 20, that is threaded from beneath into a second boss 188 on the top bracket. Accordingly, the traverse cord, which is an elongated cord, has two ends which are anchored to the lead carrier so that the cord forms or defines an endless loop secured to the lead carrier so that the lead carrier moves in unison with the cord. Of course, as mentioned previously, movement of the lead carrier causes a corresponding movement of the remaining standard, or follower, carriers 26S due to their interconnection with the pantograph 44.

The traverse cord loop extends at one end of the headrail around the horizontal pulley 96 and at the opposite end of the headrail, around the two halves of the vertical dual pulley 60, and from the dual pulley hangs downwardly and passes around a free or dangling vertically oriented pulley 190 (FIG. 16) within a weighted or spring-biased housing 192 (FIGS. 1 and 16), which retains the cord in a taut condition. As will be appreciated, when one of the depending portions of the traverse cord is pulled, the lead carrier 26L is caused to slide in a first longitudinal direction relative to the headrail 20, while pulling movement of the opposite portion of the cord causes sliding movement in the opposite direction. Movement in one direction of the lead carrier, of course, extends the vanes across the architectural opening, while movement in the opposite direction retracts the vanes adjacent to one side of the opening.

Tilting or pivotal movement of the vanes 24 about their vertical axes is effected through rotational movement of the tilt rod 42, as was mentioned previously, with this movement being caused by movement of the tilt cord 80, which is wrapped around the barrel insert 70 at the control end of the headrail. While not required, in the disclosed embodiment the tilt cord has two ends which are suspended adjacent to each other and support a weighted tassel 194 (FIGS. 1 and 16) so as to hold each cord in a vertical and taut condition. Pulling a tassel 194 at one end of the cord obviously pivots the tilt rod in one direction, while pulling the tassel at the opposite end of the cord rotates the tilt rod in the opposite direction. Through the intermeshing of the worm gear 106 and pinion gears 104 within each carrier 26, the vanes suspended from the carriers are caused to rotate in one direction or the other in unison and in alignment with each other.

While the weighted tassels 194 could take on numerous configurations, FIG. 16 shows a tassel being made of a relatively heavy material, such as zinc or Zomac alloy, having a longitudinal hole 196 therethrough which receives one end of the tilt cord 80 which can be knotted to prevent the tassel from slipping from the cord. In an alternative embodiment shown in FIG. 17, an interior core 198 of a relatively heavy material such as zinc, having an axial passage 200 therethrough to receive the tilt cord 80 can be utilized with the cord being knotted at one end to prevent release of the core and an outer shell 202 of possibly a more aesthetically attractive material being slidably received over the core.

A tassel 203 designed for suspension from the end of the beaded chain 95 is illustrated in FIGS. 29 through 33 and again is desirably made of a relatively heavy material such as zinc or Zomac alloy. As will be appreciated, the tassel is shown in hexagonal cross-sectional configuration even though other configurations would also be appropriate. The tassel is elongated having an upper crown 205 of smaller tapered diameter relative to the lower main body 207. There are three interconnected vertically aligned chambers with an upper small chamber 209 opening through the top and through one side 211 of the upper crown. The upper chamber overlaps the next adjacent lower vertically aligned intermediate chamber 213 that opens through the opposite side 215 of the upper crown. The overlap between the two chambers defines a passage 217 between the chambers that is large enough to accommodate the size of a bead in the beaded chain 95 to which the tassel is connected. The lower wall 219 of the intermediate chamber 213 is slotted with the slot 221 opening through the side of the tassel and with the wall 219 being of a thickness to fit between two adjacent beads in a beaded chain and with the slot being of a size to slidably receive the thin connector 223 between beads in a chain. The lowermost chamber 225 which lies beneath the slotted wall 219 receives the free end of the beaded chain with the slotted wall retaining the beaded chain to the tassel and with the beaded chain passing upwardly through the passage 217 between the upper and intermediate chambers and out the open top of the tassel. The side wall 215 of the upper chamber encourages the beaded chain to stay confined within the slot in the wall even though the chain can be manually removed so that the tassel can be attached to or removed from the beaded chain or adjusted in length as desired.

Figure 11:
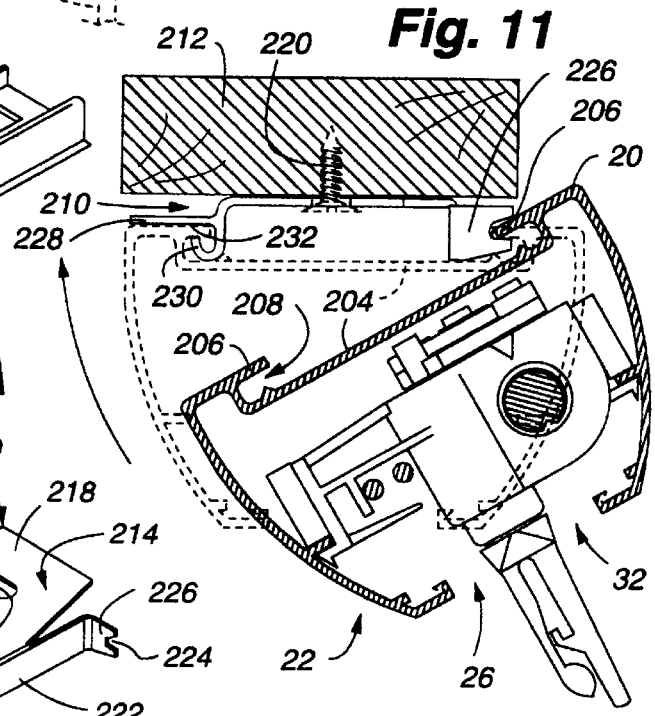
FIG. 11 is an operational view similar to FIG. 10 showing the mounting of the headrail to a supporting beam.
Figure 12:
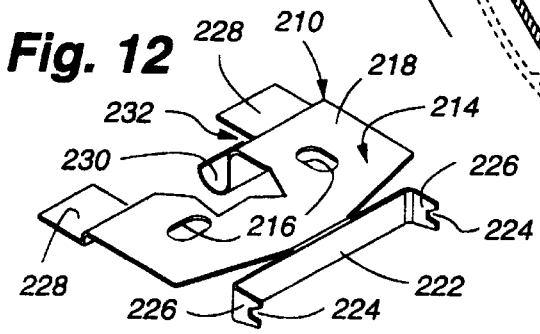
FIG. 12 is an isometric view of a mounting bracket used to secure the headrail to a supporting beam.

As mentioned previously, the headrail 20 is provided with a broad groove 34 along its upper surface, with the groove formed by a depressed plate portion 204 (FIGS. 1 and 11) vertically spaced from overhanging ledges 206 on the top of the headrail. The space between the ledges 206 and the depressed plate portion 204 define pockets 208 adapted to cooperate with a mounting plate 210 (FIGS. 11 and 12), which is securable to a beam 212 or other structural member above an architectural opening. The mounting plate, as best seen in FIGS. 11 and 12, has a flat plate-like main body 214 with openings 216 through a top plate 218 thereof adapted to receive screw-type fasteners 220 to secure the plate to the supporting beam. The plate has a generally U-shaped connector 222 on one side with notches 224 on the free ends of legs 226 of the connector and plate-like horizontal extensions 228 extending in the opposite direction. The horizontal extensions 228 overlie and are spaced from a hook-shaped projection 230 from the bottom of the top plate. The horizontal extensions are spaced above the hook-shaped projection 230 so as to define a pocket 232 adapted to receive one of the overhanging ledges 206 of the headrail, while the other overhanging ledge 206 is received in the notches 224 in the free ends of the legs 226 on the U-shaped connector. When connecting the headrail to the mounting plate, one overhanging ledge 206 is inserted into the notches on the U-shaped connector and the headrail is then pivoted, as shown in FIG. 11, until the overhanging ledges are horizontally aligned, with the second horizontal ledge being snapped into the pocket 232 between the hook-shaped projection 230 and the horizontal extensions 228. The headrail can be removed from the mounting plate in a reverse procedure, with it being understood that the hook-shaped projection is flexible enough to be moved out of blocking alignment with the overhanging ledge.

Figure 10:
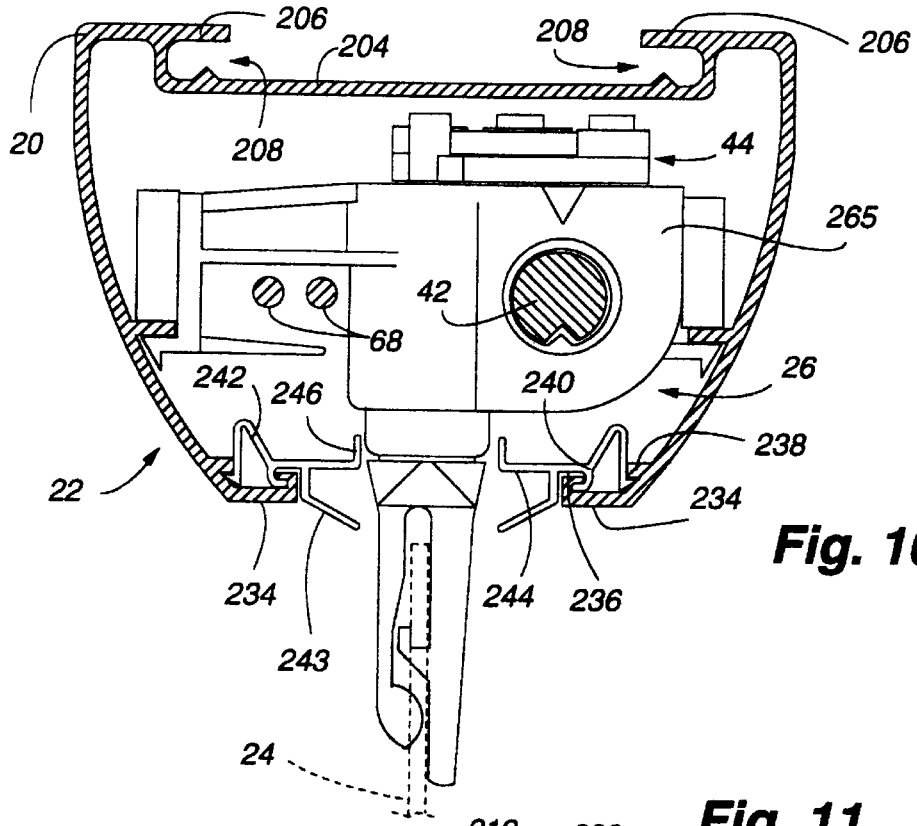
FIG. 10 is an enlarged section taken along line 10—10 of FIG. 2 with a suspended vane shown in dashed lines and illustrating light-blocking rails mounted on the headrail.
Figure 10A:
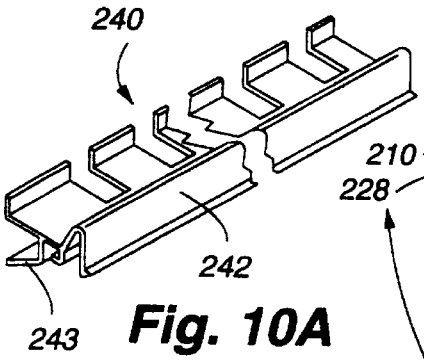
FIG. 10A is a fragmentary isometric view of one form of blocking profile that is attachable to the headrail to block the passage of light between the headrail and the suspended vanes.

The lower surface of the headrail 20, as best seen in FIG. 10, defines two parallel ledges 234. The innermost extent of each ledge has an inverted hook-shaped protrusion 236 which confronts an inwardly directed protrusion 238 from the associated arcuate side wall 30. The two protrusions define a pocket therebetween. Each pocket is adapted to receive a portion of a light-blocking rail or gap-restricting profile 240, which extends longitudinally of the headrail. The light blocking rail, as best seen in FIG. 10A, has an inverted V-shaped channel 242 formed along one side, with laterally directed edges adapted to extend beneath the protrusions 236 and 238 on the headrail. The edges thereby support the light-blocking rail and incorporate it into the headrail so that an angled flange 243 which extends downwardly through the longitudinal slot 32 in the headrail at an acute angle to horizontal from the associated ledge 234 on the bottom plate substantially fills the gap between the bottom of the headrail and the top of the suspended vanes. The flange 243 thereby forms a light-blocking barrier to light which might pass beneath the headrail 20 but above the top edge of the vanes 24. The angle of the light-blocking flange prevents damage to the vanes in the event they swing about their connection to the hanger pins, such as in air currents passing through the architectural opening, as the vanes would then engage the light blocking rail at a non-damaging angle.

The depending angled flange 243 is interconnected with a horizontal leg 244 of each light-blocking rail, which in turn has an upturned lip 246 on its innermost end. The horizontal inturned leg 244 need not be continuous along the length of the light-blocking bar so as to save material costs and to increase flexibility. The horizontal leg 244 functions as a tilt rod support which prevents the tilt rod from sagging beneath the headrail when the carriers are drawn to one side. When the carriers are distributed along the length of the tilt rod, they too assist in supporting the tilt rod through their support on the tracks 166.

Figure 18:
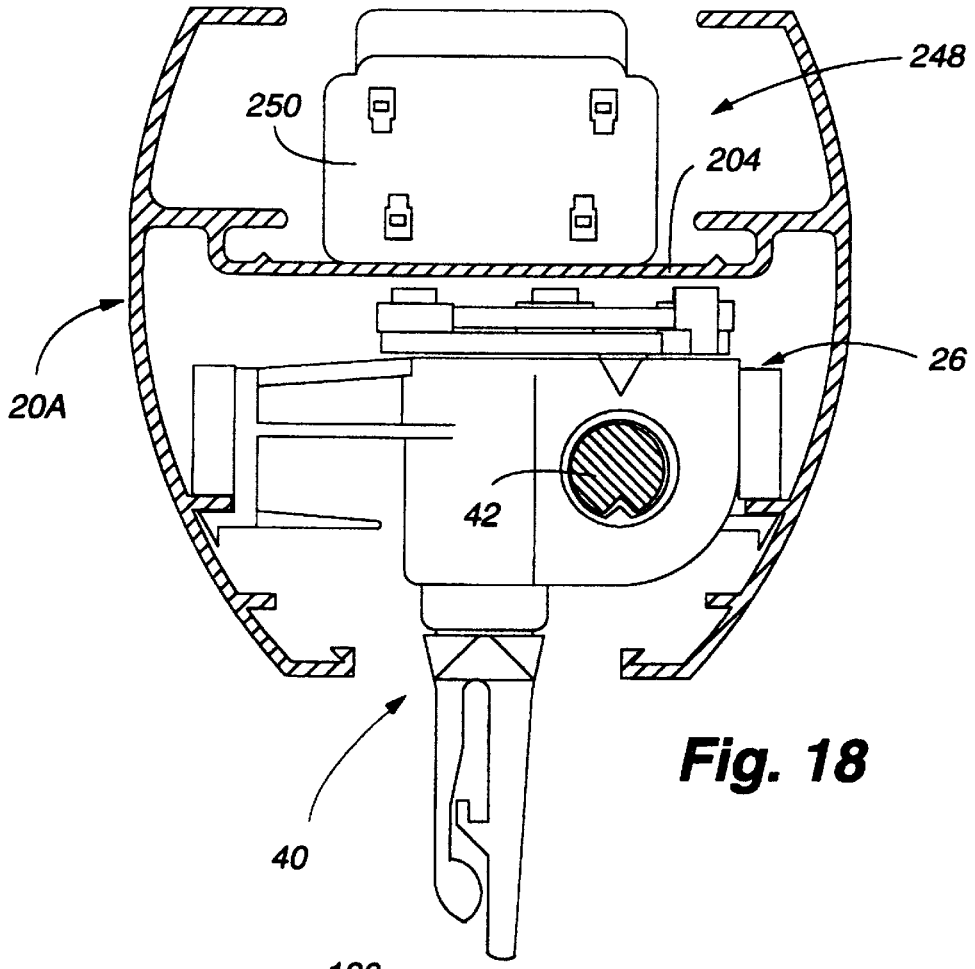
FIG. 18 is a diagrammatic section taken through a modified embodiment of the operating system of the present invention showing a standard carrier and an electric motor operatively connectable to the tilt rod to selectively pivot the carriers.

In an alternative embodiment of the invention, as shown schematically in FIG. 18, the headrail 20A is enlarged vertically so as to define a pocket 248 above the depressed plate portion 204 in which an electric motor or motors 250 can be mounted and used to operate the traverse cord and/or tilt rod for automated operation of the control system. The manner in which the motor or motors would be connected to the tilt rod or to the cords would be within the skill of one in the art and, therefore, has not been described in detail.

As was mentioned previously, the lead carrier 26L in the preferred embodiment is simply a standard carrier 26S having been modified with the inclusion of a top bracket or carrier plate 100. An alternative lead carrier 252 is shown in FIG. 14. The lead carrier 252 is a single unit comprised of a hollow main body 254 which pivotally supports a hanger pin 40 with a pinion gear 104 that is meshed with a worm gear 106 through which the tilt rod 42 extends and is keyed for unitary rotative movement. These portions of the lead carrier are the same as described in connection with lead carrier 26L. The main body includes a channel 256 through which both segments of the traverse cord 68 enter and only the outer segment 68A passes through for further extension around the horizontal pulley 96 at the end of the headrail. The inner segment 68B of the traverse cord is secured in a central downwardly opening channel 258 of the lead carrier by a set screw 260 threaded into a boss 262 formed on the carrier main body, while the returning outer segment 68A of the traverse cord enters the same downwardly opening channel 258 from the opposite direction, and is also secured in the channel by a set screw (not seen) that is threaded into a second boss 264 provided on the main body of the carrier. The main carrier body has two outwardly opening, horizontally disposed V-shaped brackets 266 having lower edges 268 that are adapted to slide along the tracks 166 of the headrail. The V-shaped brackets are elongated so as to cooperate with the elongated side walls 30 of the headrail in keeping the carriers from skewing relative to the tilt rod as the carrier is moved along the length of the headrail by the pantograph. Accordingly, the elongated V-shaped channels add still another system for assuring alignment of the carriers to facilitate free sliding movement for ease of operation of the system.

A second embodiment 270 of a pantograph for use in the present invention is illustrated in FIGS. 34 through 41. As will be appreciated, the pantograph includes male and female links 272 and 274 respectively which are pivotally interconnected with each other and with the female link being additionally pivotally connected with the protrusion 120' on a carrier 26'. The female link 274 is best seen in FIGS. 38 through 41 to include a first set of three openings 276 and a second pair of openings 278 positioned between adjacent openings 276 of the first set. The three openings in the first set are positioned at opposite ends of the link and at its longitudinal center. The link is thickened with bosses 280 at each opening 276. The bosses project from the top surface of the link with the bottom surface being substantially flat. Within each boss, there is a frustoconical surface 282 that tapers inwardly for a purpose to be described later. Beyond the tapered surface is a relatively large cylindrical recess 284 which communicates with the frustoconical surface. Each of the openings 278 in the pair of openings is a mirror image of the other and includes a cylindrical passage 286 with a rectangular keyway 288 extending completely through the link. The keyways extend from the cylindrical passage toward the center of the link as best seen in FIG. 40.

Figure 34:
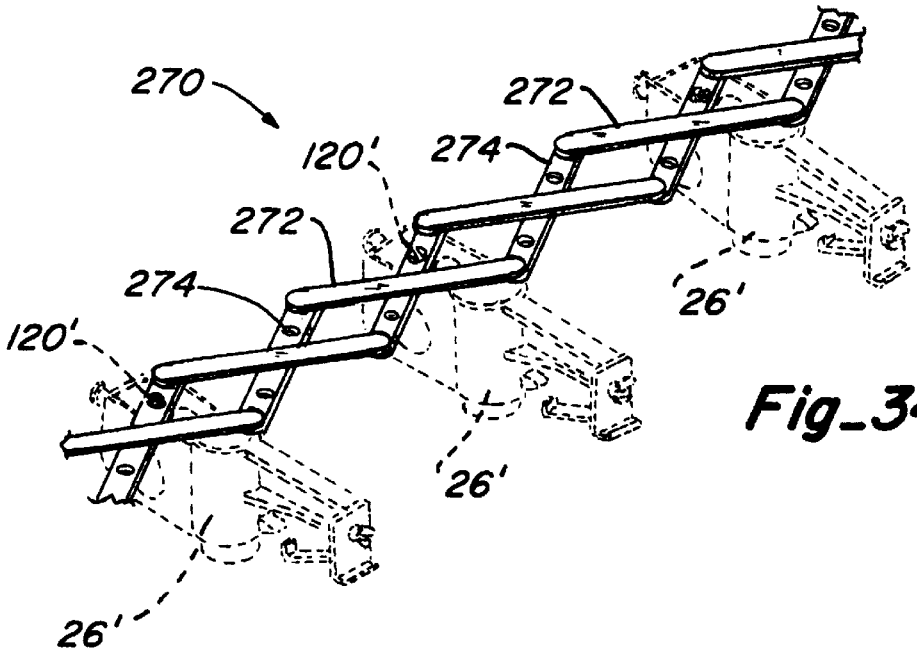
FIG. 34 is an isometric view of an alternative embodiment of the pantograph used in the control system of the present invention with phantom line representations of carriers connected thereto.
Figure 35:
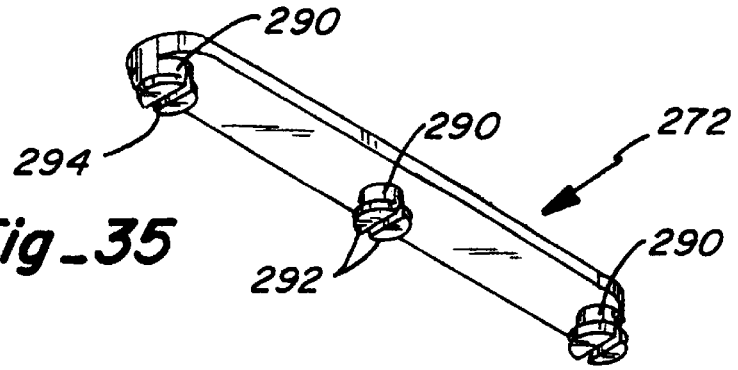
FIG. 35 is an isometric view looking up at the bottom of a male link in the pantograph of FIG. 34.
Figure 36:
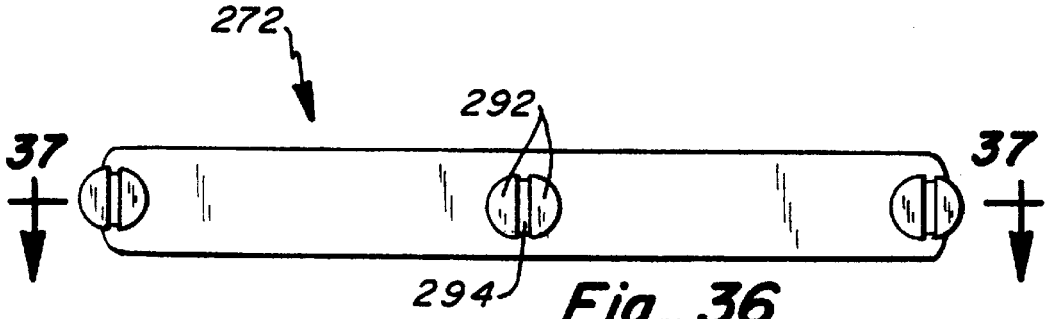
FIG. 36 is a bottom plan view of the male link shown in FIG. 35.
Figure 37:
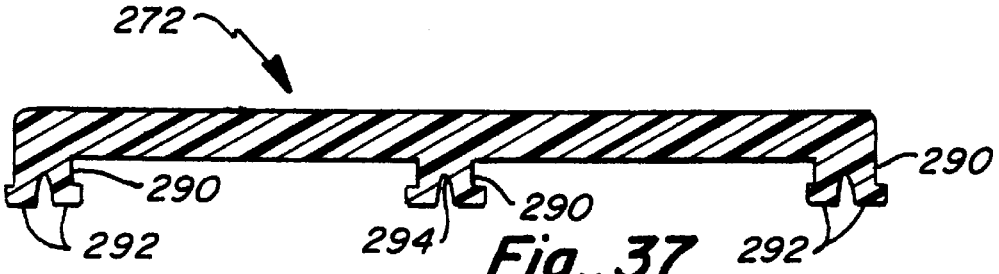
FIG. 37 is a section taken along line 37—37 of FIG. 36.
Figure 43:
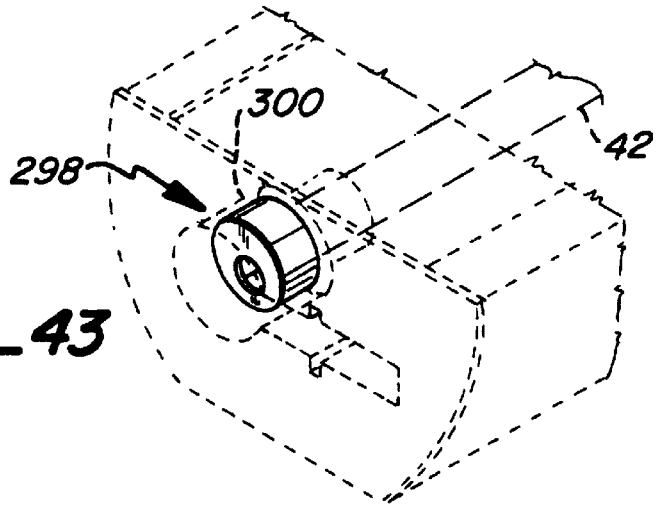
FIG. 43 is an isometric view of the lock collar secured to the end of the tilt rod and with the end cap and a portion of the headrail shown in phantom lines.
Figure 44:
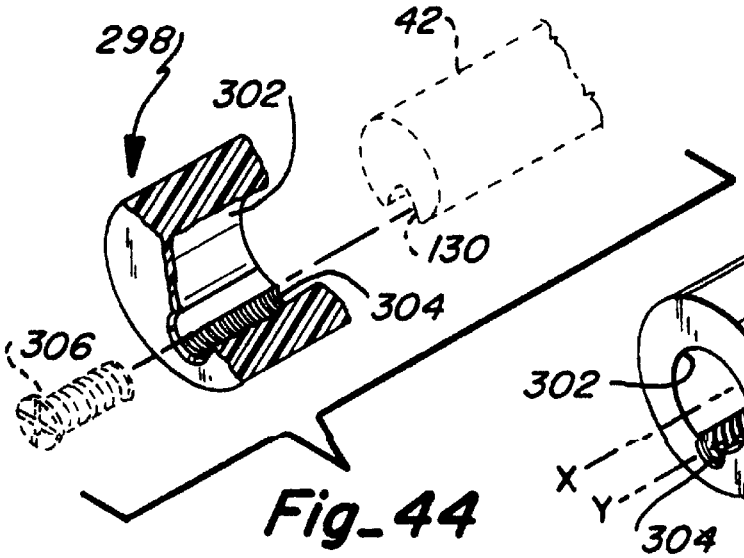
FIG. 44 is an exploded fragmentary view of the lock collar of FIG. 42 with an end of the tilt rod and a fastening screw shown in phantom lines.

The male link 272, as best seen in FIGS. 35 through 37, has a relatively flat top surface and three downwardly projecting pins 290 which have semi-circular lips 292 projecting in opposite longitudinal directions. The semi-circular lips are separated by a slot 294 which allows the lips to flex inwardly toward each other for purposes of being releasably snap connected to a female link as will be described hereafter. When connecting a male link to a female link as shown in FIG. 34, the pins 290 on the male link are advanced against the frustoconical surface 282 of a desired opening in the female link and the frustoconical surface cams the lips of the pin toward each other until they pass through the reduced diameter of the frustoconical surface. Upon reaching the relatively large cylindrical recess 284 the lips expand thereby being pivotally captured within an opening 276 in the female link. The male and female links are thereby pivotally interconnected. The protrusion 120' on the top of each carrier 26' has a rectangular tab 296 (FIG. 27) which is sized to fit through the keyway 288 of the circular openings 278 in the female member. Once the tab has been inserted through the keyway, the carrier is rotated slightly and is thereby releasably and pivotally locked to the associated female link. Due to the relationship of the female links to the carriers, once the system is mounted in the headrail the keyway will not become aligned with the tab and, therefore, the female links will not be accidentally released from the carriers. With the male and female links interconnected with each other and with the female links connected to the carriers as illustrated in FIG. 34, the entire pantograph with the connected carriers is desirably assembled for maintenance-free operation.

Figure 42:
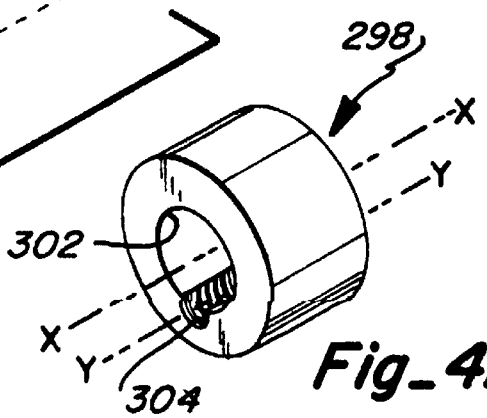
FIG. 42 is an isometric view of a lock collar used to secure the tilt rod in the end cap at one end of the headrail.
Figure 45:
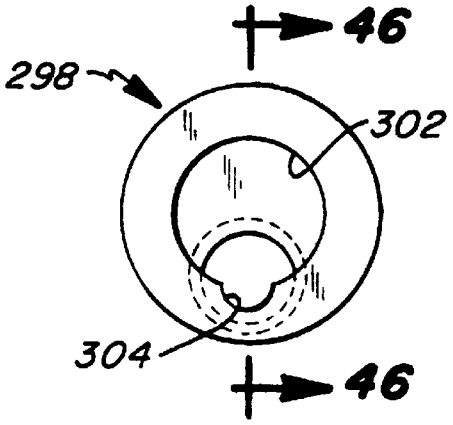
FIG. 45 is an end elevation of the lock collar shown in FIG. 42.
Figure 46:
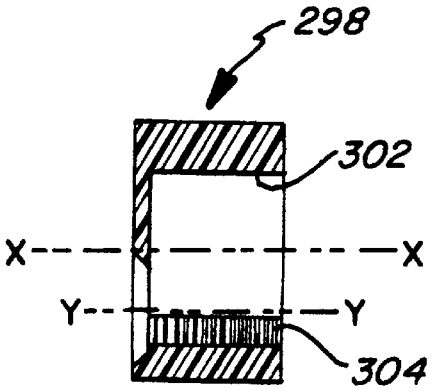
FIG. 46 is a section taken along line 46—46 of FIG. 45.

It has been found in relatively long coverings that the tilt rod 42 has enough flex that it will sometimes be released from the bearing 86 in the mounting plate 46. To prevent the tilt rod from being released, a lock collar 298, best seen in FIGS. 42 through 46, has been designed to be connected to the end of the tilt rod and rotatably seated within a cavity 300 in the large cylindrical portion of the bearing 86 previously described in connection with FIG. 3. The anchor collar 298 is a cylindrical member having a cylindrical passageway 302 of slightly larger diameter than the tilt rod extending therethrough. The cylindrical passageway has an axially extending threaded groove 304 which is alignable with the longitudinal V-shaped groove in the tilt rod 42 so that the groove 130 in the tilt rod and the threaded groove in the cylindrical passageway complement each other to define a cylindrical hole into which a threaded screw-type fastener 306 can be advanced. As is best seen in FIGS. 42 and 45, the center of the defined hole is substantially aligned with the edge of the cylindrical passageway 302 through the collar so that when the screw-type fastener is advanced into the defined hole, the head of the screw overlies the end of the collar whereby the screw is prevented from being pulled through the collar and the tilt rod, which is now self-threadedly engaged with the screw, is also prevented from being pulled out of the collar. In this manner, with the collar seated within the bearing 86, the tilt rod cannot be released from the mounting plate even on relatively long headrails that incorporate relatively long tilt rods.

Figure 47:
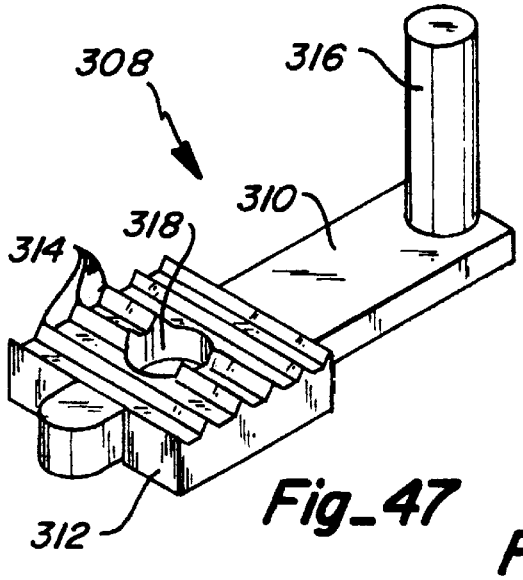
FIG. 47 is an isometric view of an anchor plate for securing the ends of the traverse cord to the lead carrier in the control system of the present invention.
Figure 48A:
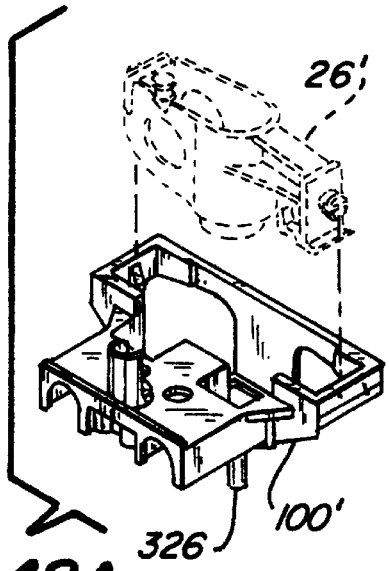
FIG. 48A is an isometric view looking downwardly on the top bracket shown in FIG. 48 and with a standard carrier shown removed from the top bracket and in phantom lines.
Figure 48:
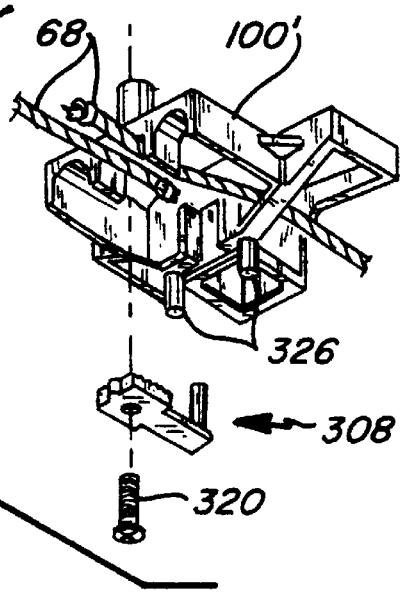
FIG. 48 is an isometric view looking up from the bottom of the top bracket used in conjunction with a conventional carrier to define the lead carrier and with the anchor plate being shown removed therefrom.
Figure 49:
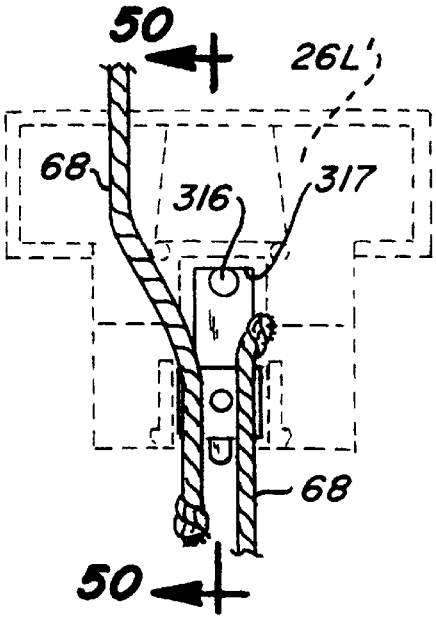
FIG. 49 is a bottom plan view of the anchor plate of FIG. 47 with the top bracket of a lead carrier shown in phantom lines.
Figure 50:
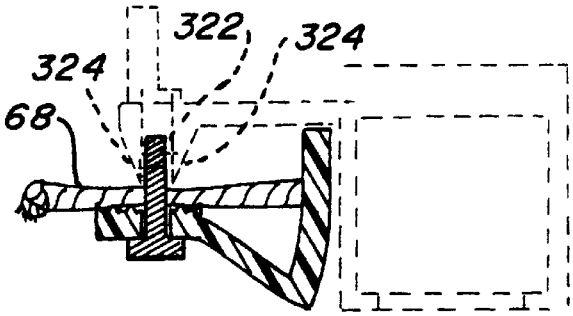
FIG. 50 is a section taken along line 50—50 of FIG. 49.
Figure 52:
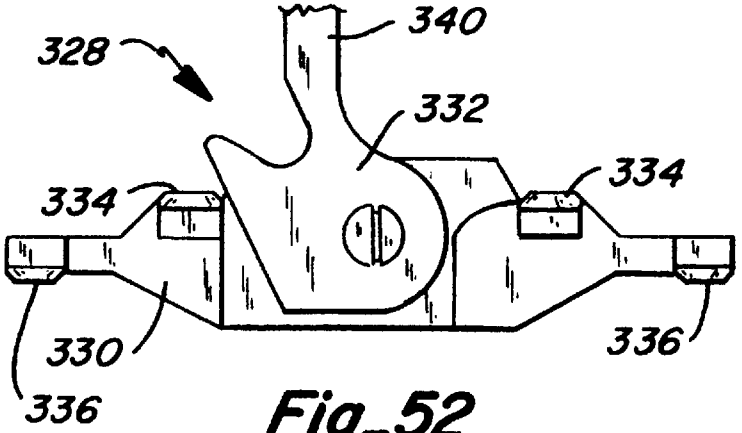
FIG. 52 is a fragmentary bottom plan view similar to FIG. 51 with the support system in a supporting position.
Figure 51:
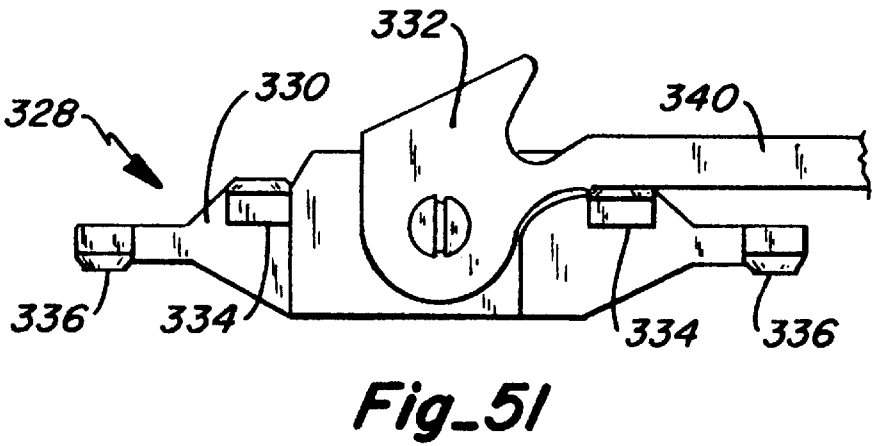
FIG. 51 is a fragmentary bottom plan view of a cord support system with the system in a nonsupporting position.

An alternative system for anchoring the ends of the pull cord to the lead carrier is illustrated in FIGS. 47 through 50. An anchor plate 308, as best seen in FIG. 47, includes an elongated substantially rectangular base 310 having an enlarged square head 312 at one end with transverse serrations 314 formed therein and an upstanding cylindrical pin 316 at the opposite end. The enlarged square head has a circular hole 318 therethrough adapted to receive a screw-type threaded fastener 320. As described previously in connection with FIGS. 15, 19, and 20, the ends of the traverse cord 68 were secured to the lead carrier 26L with a pair of screw-type fasteners with each of the fasteners pinching and end of the cord between the head of the screw-type fastener and the main body of the carrier. When utilizing the alternative arrangement, the carrier 26' is joined to a top bracket 100' that is similar to the top bracket 100 described previously. The top bracket 100' has a single threaded hole 322 at the approximate location of the two holes in the bosses 188 of the previously described top bracket 100. The screw-type fastener 320 shown in FIGS. 48 and 50 is adapted to pass through the hole 318 in the relatively large square head of the anchor plate and be threadedly received in the single threaded hole 322. The anchor plate is positioned such that the serrated head overlies both ends of the pull cord 68 and the upstanding cylindrical pin 316 is abutted against a wall 317 of the carrier, as best shown in FIGS. 49 and 50. In this manner, the anchor plate lies between two partitions on the lead carrier which prevent lateral displacement of the anchor plate while the cylindrical pin prevents longitudinal movement. Once the screw-type fastener 320 is advanced through the opening in the anchor plate and into the threaded hole 322 in the top bracket 100', the serrated head pinches the ends of the traverse cord against a pair of teeth 324 formed on the top bracket 100' thereby preventing cord displacement. In doing so, the rectangular base of the anchor plate 308 is bent or flexed as shown in FIG. 50, and is securely positioned so that the cord will not be released until the screw-type fastener is removed. The top bracket 100' also has a pair of depending trigger pins 326 for a purpose to be defined hereafter.

It has been found on relatively long headrails that when the vanes and carriers 26' are all positioned to one side of the headrail as when the covering in an open position, the traverse cord 68 will sometimes sag and be visible through the bottom of the headrail. While, as mentioned previously, the traverse cord is supported by each of the carriers, when the covering is in an open position, the carriers are all stacked adjacent one side of the headrail thereby leaving the cords unsupported along substantially the remaining length of the headrail. FIGS. 51 through 59 illustrate a cord support 328 which is operative to support the cords along the length of the headrail when the carriers are retracted into an open or substantially open position, but which are rendered inoperative when the lead carrier passes thereby as the covering is being closed.

The cord support 328 includes two pieces, a base piece 330 and a pivot or support arm 332. The base piece is anchorable at any selected location along the length of the headrail to one of the lips adjacent the slot 32 in the bottom of the headrail. The base piece includes four tabs with one set of two tabs 334 being longitudinally aligned along one side of the base and another set of two tabs 336 being slightly laterally offset but similarly longitudinally aligned so that a straight line gap is established between the first set of tabs and the second set. The lip of the headrail is positioned in the straight line gap and the base is thereby secured to the headrail at any selected location along the length of the headrail. The base has a depending pin 338 with an enlarged head and a slot therethrough so that the head can flex inwardly to allow the pivot arm 332 to be pivotally connected to the base.

The pivot arm 332 can be seen to have a relatively long and substantially straight shank 340 and an enlarged head 342 having a circular passage 344 therethrough adapted to pivotally receive the pin 338 on the base. The enlarged head 342 on the support arm also has a small projection or catch arm 346 extending angularly relative to the shank and defining a pocket in the enlarged head between the catch arm and the shank. The catch arm extends laterally a small distance beyond the side of the shank for a purpose to be described hereafter. The support arm 332 is adapted to swing through a 90 degree arc between a position extending perpendicularly to the base 330 and transversely of the headrail wherein it underlies the traverse cord 68 and supports the same and a second position extending parallel with the base and in longitudinal alignment with the headrail along one side of the slot in the bottom of the headrail. It will be appreciated particularly by reference to FIGS. 54 and 56, that the base has a depending elongated bead 348 of triangular cross-section extending transversely and aligned with the pivot pin 338, while the top side of the support arm has complementing criss-crossing grooves 350 that are also of triangular cross-section. The bead 348 in the base and the grooves 350 in the support arm are adapted to be releasably matingly engaged when the support arm is in either its supporting position or its nonsupporting position, and there is enough give in the pivot pin relative to the support arm to allow the arm to be releasably retained in position by the mating engagement of the bead 348 with one or the other of the perpendicular grooves 350.

Figure 58C:
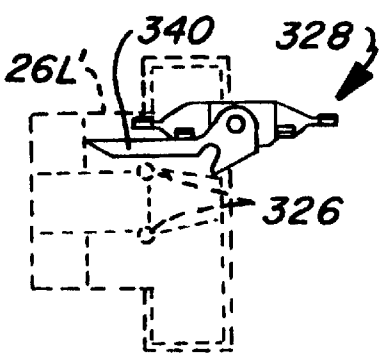
FIGS. 58A through 58C are diagrammatic operational views showing the operation of the cord support of FIG. 51.
Figure 58B:
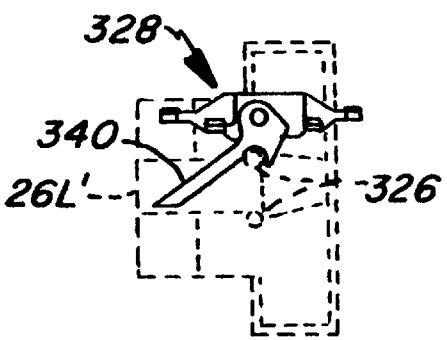
Figure 58A:
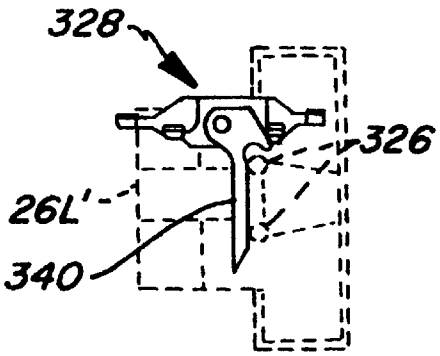
Figure 53:
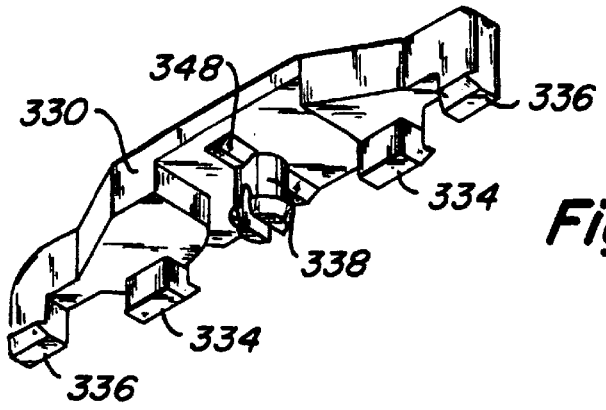
FIG. 53 is an isometric view looking up from the bottom of the base component of the support system of FIG. 51.
Figure 54:
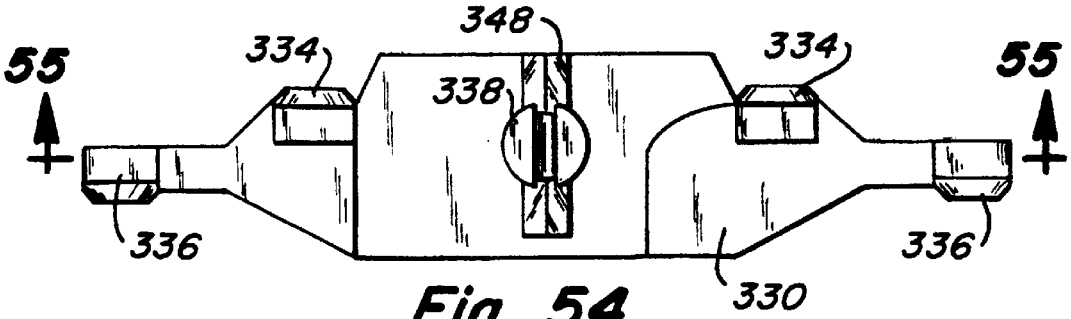
FIG. 54 is an enlarged bottom plan view of the base shown in FIG. 53.
Figure 55:
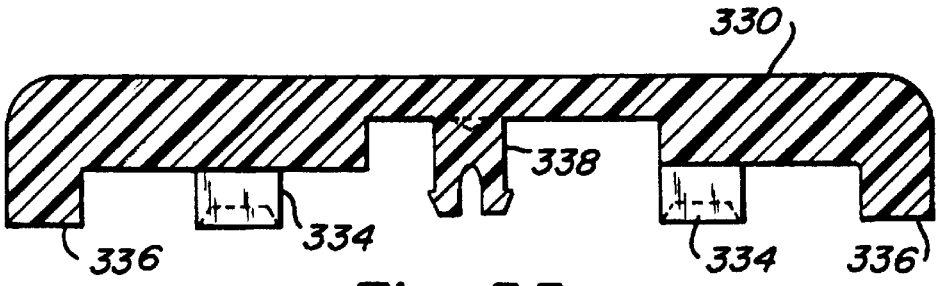
FIG. 55 is a section taken along line 55—55 of FIG. 54.
Figure 56:
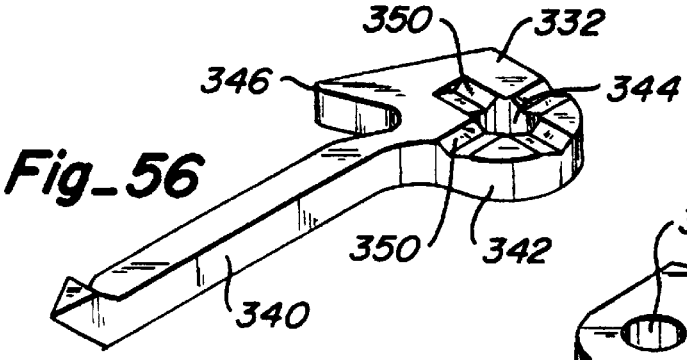
FIG. 56 is an isometric view looking downwardly on the support arm of the support system shown in FIG. 51.
Figure 57:
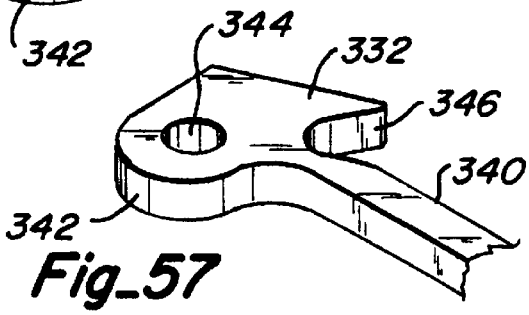
FIG. 57 is a fragmentary isometric view looking at the bottom of the support arm shown in FIG. 56.
Figures 57A, 59:
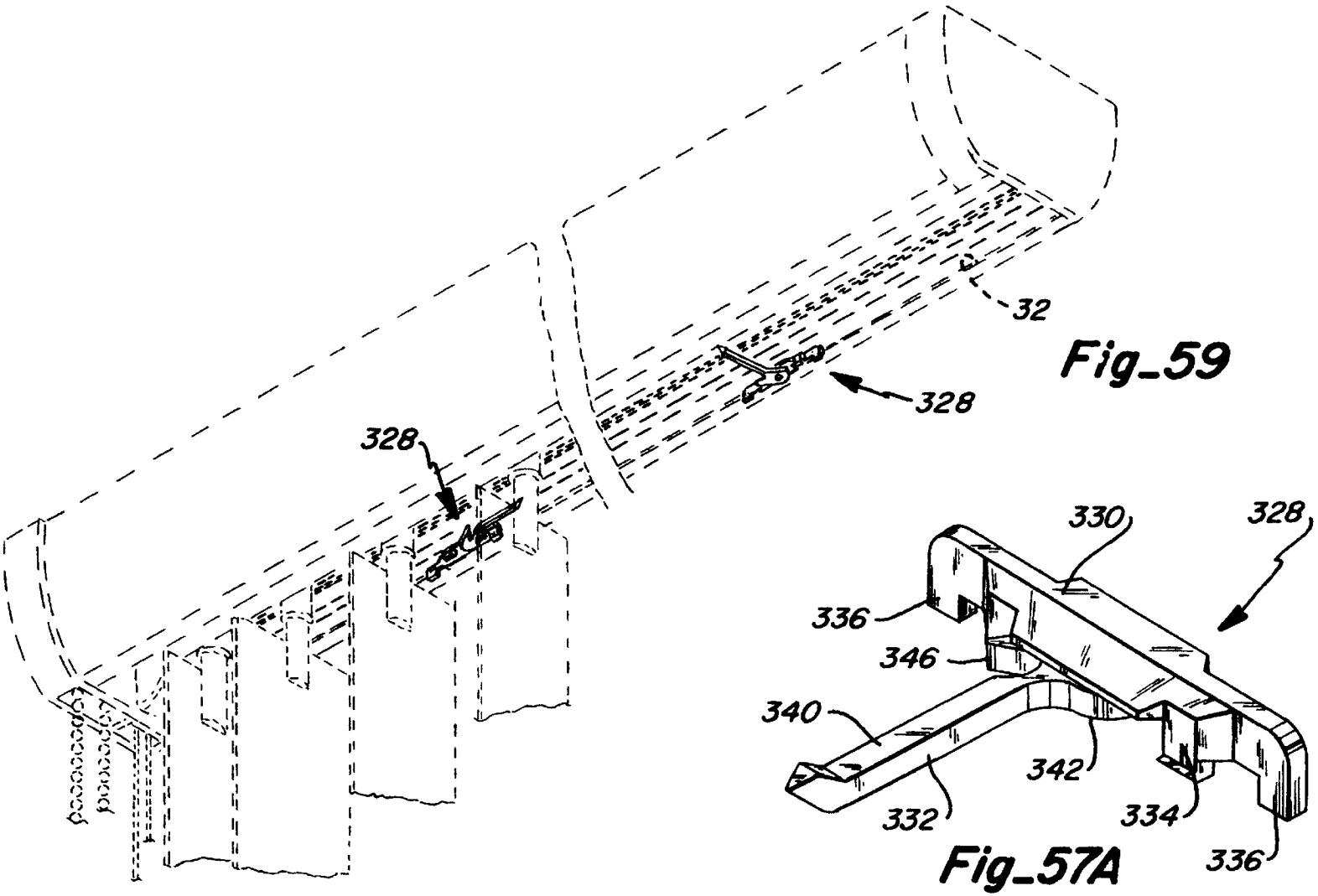
FIG. 57A is an isometric view of the cord support system of FIG. 51 looking downwardly and with the support system in a supporting position.
FIG. 59 is an isometric view of the cord support system of FIG. 58 looking upwardly from the bottom and with the cord support system incorporated into the headrail of the control system of the present invention which is shown in phantom lines.

FIGS. 58A through 58C are diagrammatic operational views showing how the support arm 332 is operatively engaged by the lead carrier 26L to move the support arm between the supporting and nonsupporting positions. In FIG. 58A, the support arm is shown in its supporting position with the lead carrier passing thereby from right to left. The trigger pins 326 on the lead carrier engage the shank 340 of the support arm causing it to pivot in a clockwise direction, as shown in FIG. 58B. After the carrier passes completely by the support arm, it is fully pivoted and releasably retained in its nonsupporting position of FIG. 58C, until the carrier passes from left to right. When passing from left to right, which is not illustrated, one of the trigger pins 326 on the lead carrier passes along the side edge of the shank of the support arm until it engages the catch arm 346, and upon engaging the catch arm pivots the support arm in a counterclockwise direction from its nonsupporting position of FIG. 58C to its supporting position of FIG. 58A. The support arm is then again in position to support the pull cords when the carriers are not present at that location.

Figure 60:
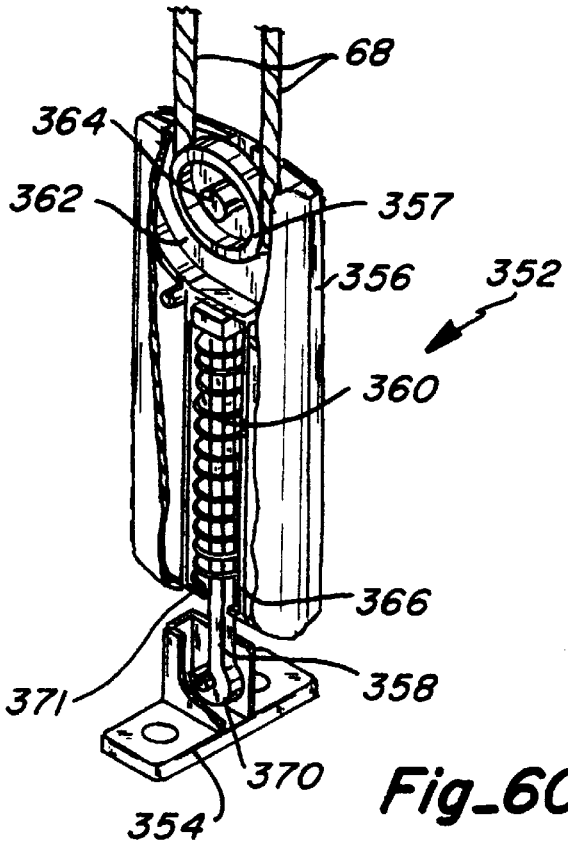
FIG. 60 is an isometric view of a cord tensioning system for the traverse cord of the control system of the present invention and with parts removed for clarity.
Figure 61:
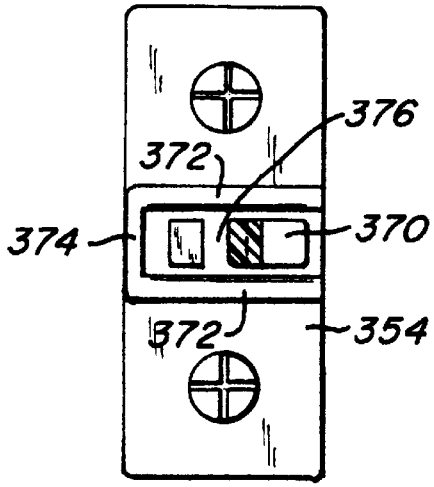
FIG. 61 is a section taken along line 61—61 of FIG. 62.

As mentioned previously, the pull or traverse cord 68 hangs in a loop from one end of the headrail with the cord in the first described embodiment passing around a pulley within a weighted housing 192 (FIG. 1). The housing illustrated in FIG. 1, for example, is simply a pulley positioned within an outer shell that is preferably weighted to hold the pull cord in a vertical position but in some instances, it is desirable to tension the pull cord. A system 352 for tensioning the pull cord is shown in FIGS. 60 through 63, and can be seen to include an anchor bracket 354 that can be mounted on a horizontal or vertical surface and a housing 356 including a pulley 357 around which the pull cord extends, an anchor pin 358 and a coil spring 360 surrounding the anchor pin. The housing has a cavity 362 with a transverse shaft 364 that rotatably supports the pulley 357 as shown in FIG. 60, and an elongated cylindrical cavity 366 that confines the anchor pin and the coil spring which is axially positioned thereon.

The anchor pin 358 has an enlarged head 368 at its upper end and a hook 370 at the lower end. The housing 356 further includes a shoulder 371 that engages the lower end of the coil spring with the upper end of the coil spring engaging the enlarged head 368 so as to confine the coil spring within the housing. The hook 370 of the anchor pin projects downwardly beyond the lower end of the housing and is adapted to be pivotally connected to the anchor bracket 354.

Figure 62:
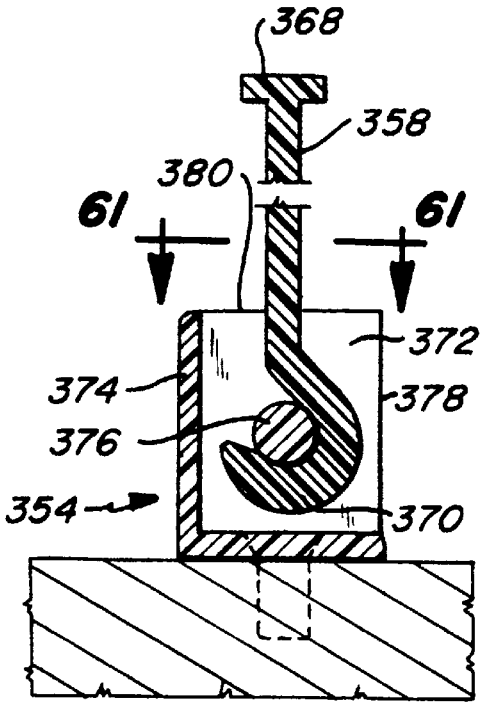
FIG. 62 is a fragmentary vertical section taken through the bracket and the anchor pin of the system shown in FIG. 60 with the bracket mounted on a horizontal surface.
Figure 63:
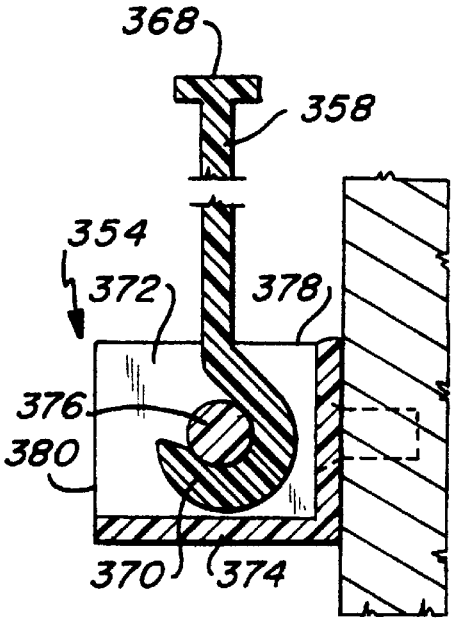
FIG. 63 is a vertical section similar to FIG. 62 with the bracket mounted on a vertical surface.
Figure 65:
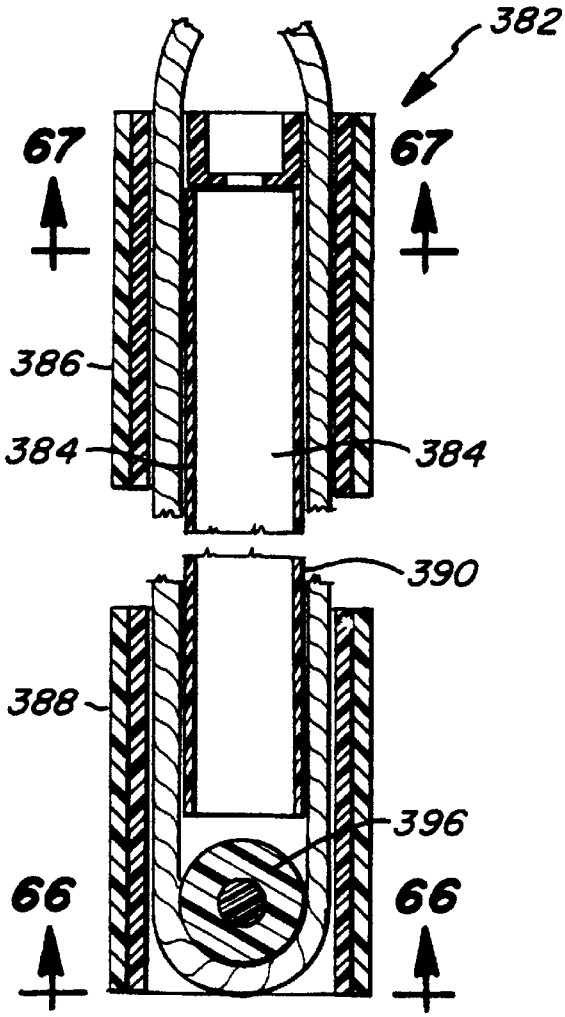
FIG. 65 is a fragmentary enlarged section taken along line 65—65 of FIG. 64.
Figure 64:
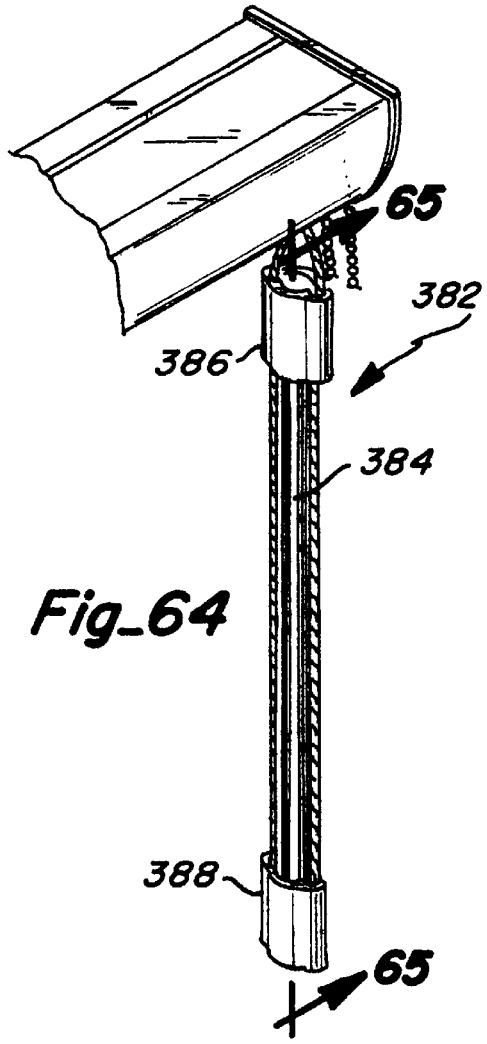
FIG. 64 is a fragmentary isometric view looking downward on a system for removing the gap between segments of the traverse cord.
Figure 66:
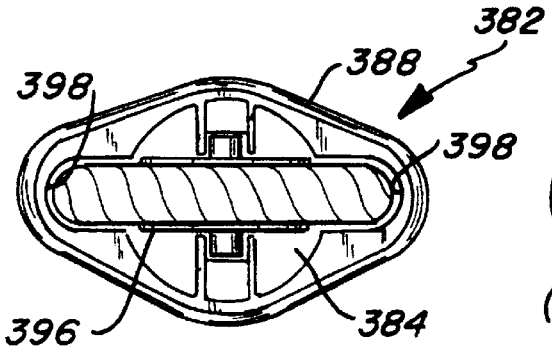
FIG. 66 is an enlarged view taken along line 66—66 of FIG. 65.
Figure 67:
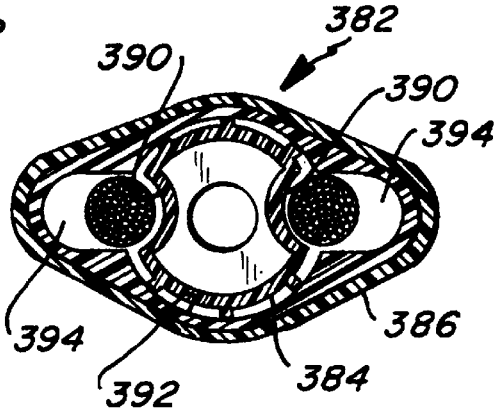
FIG. 67 is an enlarged section taken along line 67—67 of FIG. 65.

The anchor bracket 354 has a pair of spaced parallel side walls 372 and an end wall 374 connecting the side walls so as to define a cavity therebetween, a horizontal cross shaft 376 extends between the side walls and forms a pivot anchor for the hook of the anchor pin. As will be appreciated, the cavity between the side walls opens in two mutually perpendicular directions out of two ends 378 and 380 of the bracket so that the bracket can be mounted on a horizontal surface as shown in FIG. 62 or a vertical surface as shown in FIG. 63 with the anchor pin protruding out of the cavity through one of the open ends. It will be appreciated that in operation, the anchor pin can be extended down and hooked around the cross shaft 376 to releasably secure the housing to the bracket. The coil spring 360, of course, biases the housing downwardly and toward the bracket placing a tension in the pull cord.

In recent years there has been increased emphasis on making pull cords less amenable to child mishaps which are caused when the cords hang loosely and are separated thereby defining a gap between the cords into which a child can insert a body part. FIGS. 64 through 67 illustrate a system 382 for removing the gap between the cords which consists of utilizing a elongated wand 384 with frictionally retained end caps 386 and 388 at the top and bottom end respectively. The wand 384 includes longitudinally extending grooves 390 on diametrically opposite sides and the caps at opposite ends of the wand are adapted to confine the cord at the ends of the wand and encourage the cord to remain within the longitudinally extending grooves 390. The cap 386 at the upper end of the wand is spaced only a small distance from the headrail of the window covering and has a large substantially cylindrical passage 392 therethrough adapted to frictionally receive the end of the wand. The top end cap further includes a pair of laterally displaced passages 394 of ovular cross-section through which the cord slidably passes with these slots being aligned with the longitudinal grooves 390 in the wand. The lower end cap 388 is similar to the upper end cap in shape and configuration but in addition includes a pulley 396 rotatably supported therein and around which the pull cord extends. Of course, the pulley 396 is aligned with the grooves in the wand as well as the ovular slots 398 in the lower end cap. The length of the looped pull cord depending from the headrail is predetermined to substantially conform with the length of the wand so that the cords are restrained within the grooves provided in the wand but can be gripped by an operator of the window covering and separated from the wand enough to allow the operator to pull the cord in either direction.

It will also be apparent that the cord tensioner illustrated in FIGS. 60 through 63 could also be incorporated as the lower end cap for the wand with only slight modifications.

As an alternative to the bracket 210 described previously for mounting the headrail to an overlying beam or other structural member, a bracket 400 as shown in FIGS. 68 through 71 can be used. The bracket is again adapted to be connected to and between the overhanging ledges 206 on the top of the headrail. As mentioned previously, the space between ledges 206 and the depressed plate portion 204 define pockets 208 adapted to cooperate with the mounting plate. The mounting plate 400 has a flat plate-like main body 402 with openings 404 therethrough adapted to receive screw-type fasteners 406 to secure the plate to the supporting beam or other structural member. The plate-like main body has a generally U-shaped connector 408 on one side with notches 410 on the free ends of legs 412 of the connector and transversely extending side walls 414 having notches 416 in the ends opposite the U-shaped connector.

The notches 416 in the side walls are adapted to engage and receive one overhanging ledge 206, while the notches 410 in the U-shaped connector are adapted to receive the opposite overhanging ledge 206 so that the bracket is releasably connectable to the ledges thereby supporting the headrail from the overlying support beam.

It will be appreciated from the above that a control system for a vertical vane covering for an architectural opening has been described in various embodiments which has a number of advantages over prior art systems. Due to the alignment of the connection of the pantograph 44 with each carrier 26 over the tilt rod 42, skewing of the carriers is minimized. Similarly, the formation of pockets in each carrier to receive the traverse cords and position the cords closely adjacent to the tilt rod also minimizes skewing so that the carriers are enabled to move easily along the headrail and the tilt rod. A low friction coating of the tilt rod further enhances the easy sliding movement.

The longitudinal groove 130 in the tilt rod, which cooperates with the protrusion on the worm gear 106 in each carrier, facilitates an easy assembly of the system in that the relative positioning of the worm gear 106 and pinion gear 104 can be made on each carrier so that the vanes associated with each carrier are positioned uniformly angularly. With this uniform relationship, an insertion of the tilt rod through the worm gears in each carrier allows the vanes to be very easily mounted and angularly aligned upon assembly.

The light blocking rails 240 are also easily connected to the headrail 20 and positioned in an aesthetically attractive position to not only substantially block the passage of light between the headrail on the top edge of the vanes 24 but in a manner such that the vanes are not damaged should they swing about their connection to the hanger pins.

The relatively large pulleys 60 and 96 used on the traverse cord enable an easy operation of the system while minimizing wear and heat generation to extend the life of the system. Further, the headrail 20 itself is symmetric about a longitudinal vertical central plane so that it can be mounted in either direction. This not only makes the system easy to mount, but also facilitates hiding a marred or blemished side wall of a head rail thereby salvaging headrails that might not be usable in other systems.

Although the present invention has been described with a certain degree of particularity, it is understood that the present disclosure has been made by way of example, and changes in detail or structure may be made without departing from the spirit from the invention, as defined in the appended claims.

What is claimed is:

1. A control system for a covering for an architectural opening wherein the covering includes a plurality of vertically oriented covering segments adapted to be moved horizontally between an extended position wherein the segments are distributed across the architectural opening and a retracted position wherein the segments are horizontally stacked adjacent to at least one side of the architectural opening, said control system comprising in combination:

an elongated headrail adapted to extend across the architectural opening, said headrail having a length;

a pantograph system mounted in said headrail, said pantograph system including two sets of releasably connected links, said two sets including a set of female links and a set of male links, wherein there is an equal number of female and male links, with said female links being parallel with each other and having uniformly arranged first ends and second ends, and, said male links being parallel with each other but not with said female links, said male links having uniformly arranged first ends and second ends, each said male link having three laterally compressible pins, including two end pins and one center pin, protruding from and substantially evenly spaced along one of its sides, and each of said female links having three evenly-spaced corresponding holes therethrough including two end holes and a center hole, each of said holes having a frustoconical surface, and wherein each of said female links is paired with one of said male links forming a plurality of link pairs including a first link pair and an adjacent link pair, wherein said first link pair comprises a first male link and a first female link and said adjacent link pair comprises a second male link and a second female link, wherein said center pin of said first male link is releasably connected to said center hole of said first female link, and said center pin of said second male link is releasably connected to said center hole of said second female link, and where said first link pair is releasably connected to said adjacent link pair by connecting said end pin on said first end of said first male link to said end hole on said second end of said second female link, and by connecting said end pin on said second end of said second male link to said end hole on said first end of said first female link;

a plurality of carriers adapted to support the covering segments, said carriers operatively supported and interconnected by said female links of said pantograph system, wherein said female links further include at least one opening between said center hole and one of said two end holes, and wherein each of said carriers includes a protrusion that is pivotally connected to one of said at least one openings in said female links; and an operating mechanism connected to said carriers for moving said carriers along said length of said headrail.

2. A control system for a covering for an architectural opening wherein the covering includes a plurality of vertically oriented covering segments adapted to be moved horizontally between an extended position wherein the segments are distributed across the architectural opening and a retracted position wherein the segments are horizontally stacked adjacent to at least one side of the architectural opening, said control system comprising in combination:

an elongated headrail adapted to extend across the architectural opening, wherein said headrail has a length and opposite ends, a plurality of carriers operatively supported by and movable along said length of said headrail, said carriers adapted to support the covering segments, an elongated tilt rod extending along said length of said headrail and being operatively connected to said carriers, and mounting plates at said opposite ends of said headrail having bearing means for supporting said tilt rod for rotative movement about its longitudinal axis, one of said mounting plates having a cavity formed therein for rotatively supporting a circular drive wheel, said drive wheel being secured to said tilt rod for rotation therewith, and wherein at least one of said bearing means defines a passage therethrough rotatably receiving said tilt rod and having an enlarged cavity in said passage, said enlarged cavity opening from said bearing toward an adjacent end of said headrail, an elongated flexible drive element in driving engagement with said drive wheel for selectively rotating said drive wheel and consequently said tilt rod, an end cap adjacent to at least said one mounting plate, said end cap covering said cavity and said drive wheel, and an anchor collar rotatably seated in said enlarged cavity and secured to said tilt rod to secure said tilt rod in said bearing, wherein said tilt rod further comprises a longitudinal V-shaped groove, and wherein said anchor collar is a cylindrical member having a cylindrical passage of slightly larger diameter than said tilt rod and extending at least partway through said anchor collar, wherein an axially-extending threaded groove is formed in one side of said cylindrical passage such that when said axially extending threaded groove is aligned with said longitudinal V-shaped groove in said tilt rod, said threaded groove and said V-shaped groove complement each other to define a substantially cylindrical hole into which a threaded screw-type fastener is advanced, thereby preventing said tilt rod from being inadvertently released from said at least one of said bearing means.

3. A control system for a covering for an architectural opening wherein the covering includes a plurality of vertically oriented covering segments adapted to be moved horizontally between an extended position wherein the segments are distributed across the architectural opening and a retracted position wherein the segments are horizontally stacked adjacent to at least one side of the architectural opening, said control system comprising in combination:

an elongated headrail adapted to extend across the architectural opening, said headrail having a length, a plurality of carriers operatively supported by and movable along said length of said headrail, said carriers adapted to support the covering segments, a pantograph system interconnecting said carriers, said pantograph system including two sets of links with the links of one set being parallel with each other and the links of the other set being parallel with each other but not with the links of said one set, said links in said one set having a plurality of laterally compressible pins protruding from one side and said other set of links having a plurality of holes at least some of which are adapted to rotatably receive one of said plurality of pins from said one set of links, said at least some of said holes having a tapered surface adapted to laterally compress said one of said pins being advanced thereinto in the process of releasably retaining said one of said pins in said opening, wherein each link has ends and a center substantially midway between said ends, and wherein said some of said holes in said other set of links includes one hole at each of said ends of said other set of links, and further wherein each of said other set of links has an opening therethrough between said ends and said center, and wherein one of said plurality of carriers is releasably connected to each said opening, and an operating mechanism connected to said carriers for moving said carriers along said length of said headrail.

4. A control system for a covering for an architectural opening wherein the covering includes a plurality of vertically oriented covering segments adapted to be moved horizontally between an extended position wherein the segments are distributed across the architectural opening and a retracted position wherein the segments are horizontally stacked adjacent to at least one side of the architectural opening, said control system comprising in combination:

an elongated headrail adapted to extend across the architectural opening, said headrail having a length, a plurality of carriers operatively supported by and movable along said length of said headrail, said carriers adapted to support the covering segments, a pantograph system interconnecting said carriers, said pantograph system including two sets of links with the links of one set being parallel with each other and the links of the other set being parallel with each other but not with the links of said one set, said links in said one set having a plurality of laterally compressible pins protruding from one side and said other set of links having a plurality of holes at least some of which are adapted to rotatably receive one of said plurality of pins from said one set of links, said at least some of said holes having a tapered surface adapted to laterally compress said one of said pins being advanced thereinto in the process of releasably retaining said one of said pins in said opening, and wherein said carriers are each supported by one of said links of said other set at a location other than where a link from said one set is attached to a link from said other set, and an operating mechanism connected to said carriers for moving said carriers along said length of said headrail.

5. A control system for a covering for an architectural opening wherein the covering includes a plurality of vertically oriented covering segments adapted to be moved horizontally between an extended position wherein the segments are distributed across the architectural opening and a retracted position wherein the segments are horizontally stacked adjacent to at least one side of the architectural opening, said control system comprising in combination:

an elongated headrail adapted to extend across the architectural opening, wherein said headrail has a length and opposite ends, a plurality of carriers operatively supported by and movable along said length of said headrail, said carriers adapted to support the covering segments, an elongated tilt rod extending along said length of said headrail, support bearings at said opposite ends of said headrail supporting said tilt rod for rotation about its longitudinal axis, at least one of said bearings defining a passage therethrough rotatably receiving said tilt rod and having an enlarged cavity in said passage, said enlarged cavity opening from said bearing toward the adjacent end of said headrail, and wherein one of said bearings includes a cylindrical cavity that rotatably supports a circular drive wheel, said drive wheel comprising a hollow barrel-shaped insert having a larger diameter portion and a smaller diameter portion, and wherein said barrel-shaped insert defines a relatively small diameter opening through said smaller diameter portion, said small diameter opening adapted to slideably receive and support one end of said tilt rod, a collar rotatably seated in said enlarged cavity and secured to said tilt rod to secure said tilt rod in said at least one of said bearings, wherein said tilt rod further comprises a longitudinal V-shaped groove, and wherein said collar is a cylindrical member having a cylindrical passage of slightly larger diameter than said tilt rod and extending at least partway through said collar, wherein an axially-extending threaded groove is formed in one side of said cylindrical passage such that when said annually extending threaded groove is aligned with said longitudinal V-shaped groove in said tilt rod, said threaded groove and said V-shaped groove complement each other to define a substantially cylindrical hole into which a threaded screw-type fastener is advanced, thereby preventing said tilt rod from being inadvertently released from said at least one of said bearings, and an operating mechanism for moving said carriers along said length of said headrail.

* * * * *